US008435073B2

(12) United States Patent
Wild et al.

(10) Patent No.: US 8,435,073 B2
(45) **Date of Patent: *May 7, 2013**

(54) CONNECTOR ASSEMBLY FOR CORRUGATED COAXIAL CABLE

(75) Inventors: Werner Karl Wild, Buttenwiesen (DE); Adam Thomas Nugent, Canastota, NY (US)

(73) Assignee: John Mezzalingua Associates, LLC, East Syracuse, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/178,490

(22) Filed: Jul. 8, 2011

(65) Prior Publication Data

US 2012/0088404 A1 Apr. 12, 2012

Related U.S. Application Data

(63) Continuation-in-part of application No. 13/077,582, filed on Mar. 31, 2011.

(60) Provisional application No. 61/391,290, filed on Oct. 8, 2010.

(51) Int. Cl.
*H01R 9/05* (2006.01)

(52) U.S. Cl.
USPC ..... 439/578

(58) Field of Classification Search ..... 439/578, 439/583–585, 595

See application file for complete search history.

(56) References Cited

U.S. PATENT DOCUMENTS 3,764,959 A 10/1973 Toma et al.
3,910,673 A 10/1975 Stokes
4,531,805 A 7/1985 Werth (Continued)

FOREIGN PATENT DOCUMENTS

DE 4344328 C1 1/1995
EP 1858123 A2 11/2007

(Continued)

OTHER PUBLICATIONS

Notice of Allowance (Mail Date Apr. 1, 2011) for U.S. Appl. No. 11/743,633, filed May 2, 2007.
Notice of Allowance (Mail Date Apr. 25, 2011) for U.S. Appl. No. 12/469,313, filed May 20, 2009.

(Continued)

*Primary Examiner* — Renee Luebke
*Assistant Examiner* — Harshad Patel
(74) *Attorney, Agent, or Firm* — Schmeiser, Olsen & Watts, LLP

(57) ABSTRACT

A connector comprising a connector body comprising a first end, a second end, and an inner bore defined between the first and second ends of the body, a compression member comprising a first end, a second end, and an inner bore defined between the first and second ends of the cap, the first end of the compression member being structured to engage the second end of the connector body, a clamp comprising a first end, a second end, an inner bore defined between the first and second ends of the clamp, wherein the clamp facilitates threadable insertion of a coaxial cable, and a compression surface disposed within the connector body, wherein axial advancement of the compression member facilitates the clamp being axially advanced into proximity with the compression surface such that the clamp and the compression surface transmit force between one another is provided. An associated method is also provided.

15 Claims, 19 Drawing Sheets

U.S. PATENT DOCUMENTS 4,579,415 A 4/1986 Van Brunt et al.
4,676,577 A 6/1987 Szegda
4,808,128 A 2/1989 Werth
4,952,174 A 8/1990 Sucht et al.
5,137,470 A 8/1992 Doles
5,167,533 A 12/1992 Rauwolf
5,199,894 A 4/1993 Kalny et al.
5,322,454 A 6/1994 Thommen
5,393,244 A 2/1995 Szegda
5,397,243 A 3/1995 MacMurdo, Sr.
5,435,745 A 7/1995 Booth
5,518,420 A 5/1996 Pitschi
5,620,339 A 4/1997 Gray et al.
5,720,630 A 2/1998 Richmond et al.
5,766,037 A 6/1998 Nelson
5,863,220 A 1/1999 Holliday
5,938,474 A 8/1999 Nelson
6,019,519 A 2/2000 Grinderslev et al.
6,019,636 A 2/2000 Langham
6,032,358 A 3/2000 Wild
6,102,738 A 8/2000 Macek et al.
6,109,964 A 8/2000 Kooiman
6,123,567 A 9/2000 McCarthy
6,133,532 A 10/2000 Lundback et al.
6,183,298 B1 2/2001 Henningsen et al.
6,203,360 B1 3/2001 Harting et al.
6,206,579 B1 3/2001 Selfridge et al.
6,264,374 B1 7/2001 Selfridge et al.
6,267,621 B1 7/2001 Pitschi et al.
6,272,738 B1 8/2001 Holliday et al.
6,309,251 B1 10/2001 Tang
6,331,123 B1 12/2001 Rodrigues
6,386,915 B1 5/2002 Nelson
6,471,545 B1 10/2002 Hosler, Sr.
6,478,618 B2 11/2002 Wong
6,494,743 B1 12/2002 Lamatsch et al.
6,569,565 B2 5/2003 Ligeois et al.
6,607,398 B2 8/2003 Henningsen
6,733,336 B1 5/2004 Montena et al.
6,840,803 B2 1/2005 Wlos et al.
6,878,049 B2 4/2005 Heidelberger et al.
6,884,113 B1 4/2005 Montena
6,884,115 B2 4/2005 Malloy
6,939,169 B2 9/2005 Islam et al.
6,955,562 B1 10/2005 Henningsen
6,976,872 B1 12/2005 Wild et al.
7,008,264 B2 3/2006 Wild
7,021,965 B1 4/2006 Montena
7,029,304 B2 4/2006 Montena
7,029,326 B2 4/2006 Montena
7,070,447 B1 7/2006 Montena
7,077,699 B2 7/2006 Islam et al.
7,086,897 B2 8/2006 Montena
7,104,839 B2 9/2006 Henningsen et al.
7,108,547 B2 9/2006 Kisling et al.
7,112,093 B1 9/2006 Holland
7,121,883 B1 10/2006 Petersen et al.
7,128,603 B2 10/2006 Burris et al.
7,131,868 B2 11/2006 Montena
7,156,560 B2 1/2007 Seeley
7,156,696 B1 1/2007 Montena
7,163,420 B2 1/2007 Montena
7,189,115 B1 * 3/2007 Montena ..... 439/584
7,207,838 B2 4/2007 Andreescu
7,264,502 B2 9/2007 Holland
7,278,854 B1 10/2007 Robinette et al.
7,303,435 B2 12/2007 Burris et al.
7,309,255 B2 12/2007 Rodrigues
7,335,059 B2 2/2008 Vaccaro
7,347,729 B2 3/2008 Thomas et al.
7,351,101 B1 4/2008 Montena
7,357,672 B2 4/2008 Montena
7,458,851 B2 12/2008 Montena
7,497,729 B1 3/2009 Wei
7,513,722 B2 4/2009 Greenberg et al.
7,527,512 B2 5/2009 Montena
7,566,243 B1 7/2009 Hung
7,588,460 B2 9/2009 Malloy et al.
7,632,143 B1 12/2009 Islam
7,637,774 B1 12/2009 Vaccaro
7,806,724 B2 10/2010 Paynter et al.
7,824,215 B2 11/2010 Islam et al.
7,857,661 B1 12/2010 Islam
7,918,687 B2 4/2011 Paynter et al.
7,927,134 B2 4/2011 Paynter et al.
7,993,159 B2 8/2011 Chawgo
8,007,314 B2 8/2011 Chawgo et al.
8,038,472 B2 10/2011 Montena et al.
8,047,870 B2 11/2011 Clausen
8,123,557 B2 2/2012 Montena et al.
8,177,583 B2 5/2012 Chawgo et al.
2005/0079761 A1 4/2005 Rodrigues
2006/0014427 A1 1/2006 Islam et al.
2006/0134979 A1 6/2006 Henningsen
2006/0199431 A1 9/2006 Paynter
2006/0246774 A1 11/2006 Buck
2007/0149047 A1 * 6/2007 Wild et al. ..... 439/578
2007/0270032 A1 11/2007 Eriksen
2008/0003873 A1 1/2008 Henningsen
2008/0254678 A1 * 10/2008 Amidon ..... 439/584
2008/0274643 A1 * 11/2008 Chawgo ..... 439/583
2009/0197465 A1 8/2009 Montena et al.
2009/0233482 A1 9/2009 Chawgo et al.
2009/0269979 A1 10/2009 Montena
2010/0261381 A1 10/2010 Montena et al.
2010/0261382 A1 10/2010 Montena et al.
2010/0273340 A1 10/2010 Clausen
2011/0008998 A1 1/2011 Low et al.
2011/0009000 A1 1/2011 Paynter
2011/0021074 A1 1/2011 Paynter et al.
2011/0263154 A1 10/2011 Chawgo et al.
2012/0088381 A1 4/2012 Wild et al.
2012/0088407 A1 4/2012 Natoli
2012/0102733 A1 5/2012 Wild
2012/0214338 A1 8/2012 Nugent

FOREIGN PATENT DOCUMENTS

EP 2190068 A1 5/2010
EP 2219267 B1 8/2010
EP 2219267 B1 1/2011
KR 200351496 Y1 5/2004
WO 2005004290 A1 1/2005
WO 2005004490 A1 1/2005

OTHER PUBLICATIONS

Notice of Allowance (Mail Date Jun. 13, 2011) for U.S. Appl. No. 12/421,894, filed Apr. 10, 2009.
Office Action (Mail Date Mar. 23, 2011) for U.S. Appl. No. 12/421,855, filed Apr. 20, 2009.
Application No. PCT/US2010/029725, International Search Report and the Written Opinion of the International Searching Authority, or the Declaration dated Nov. 16, 2010. 8 pages.
PCT/US2011/055429. International Search Report and Written Opinion. Date of Mailing: Dec. 16, 2011. 13 pages.
U.S. Appl. No. 61/585,481, filed Jan. 11, 2012.
U.S. Appl. No. 61/585,871, filed Jan. 12, 2012.
U.S. Appl. No. 13/178,483, filed Jul. 7, 2011.
U.S. Appl. No. 13/178,397, filed Jul. 7, 2011.
U.S. Appl. No. 13/178,443, filed Jul. 7, 2011.
U.S. Appl. No. 12/421,826, filed Apr. 10, 2009.
U.S. Appl. No. 13/174,697, filed Jun. 30, 2011.
U.S. Appl. No. 13/178,492, filed Jul. 8, 2011.
U.S. Appl. No. 61/505,535, filed Jul. 8, 2011.
U.S. Appl. No. 13/178,488, filed Jul. 7, 2011.
U.S. Appl. No. 13/178,408, filed Jul. 7, 2011.
U.S. Appl. No. 13/228,445, filed Sep. 8, 2011.
Office Action (mail Date Jun. 13, 2012) for U.S. Appl. No. 13/077,582, filed Mar. 31, 2011.
Office Action (Mail date Jun. 15, 2012) for U.S. Appl. No. 13/228,441, filed Sep. 8, 2011.
Office Action (Mail date Jun. 29, 2012) for U.S. Appl. No. 13/228,445, filed Sep. 8, 2011.
U.S. Appl. No. 13/661,962, filed Oct. 26, 2012.

* cited by examiner

CONNECTOR ASSEMBLY FOR CORRUGATED COAXIAL CABLE

CROSS-REFERENCE TO RELATED APPLICATIONS

This application claims priority to and is a continuation-in-part of U.S. application Ser. No. 13/077,582, filed on Mar. 31, 2011, and entitled "CONNECTOR ASSEMBLY FOR CORRUGATED COAXIAL CABLE," which claimed priority to U.S. Provisional Application Ser. No. 61/391,290, filed on Oct. 8, 2010.

BACKGROUND

1. Technical Field

This invention relates generally to the field of coaxial cable connectors and more particularly to a contact connector assembly for use with coaxial cables having a center conductor.

2. State of the Art

Corrugated coaxial cables are electrical cables that are used as transmission lines for radio frequency signals. Coaxial cables are composed of an inner conductor surrounded by a flexible insulating layer, which in turn is surrounded by a corrugated outer conductor that acts as a conducting shield. An outer protective sheath or jacket surrounds the corrugated outer conductor.

A corrugated coaxial cable in an operational state typically has a connector affixed on either end of the cable. The quality of the electrical connection between the coaxial cable and the respective connectors is of utmost importance. Indeed, the quality of the electrical connection can either positively or negatively impact the resulting electric signal as well as the performance of the connector. One issue that negatively impacts the electric signal between the cable and the connector is the size of the connector in relation to the size of the cable. Currently, specifically-sized connectors must be chosen for each size of cable that they are to be connected to. Improperly-sized connectors, or even improperly-selected connectors for a certain-sized cable, will negatively impact the electric signal between the cable and the connector, resulting in extremely low performance. Moreover, even when the properly-sized connector is chosen for the designated cable, variations in the actual dimensions of the manufactured cable can lead to improper installation of the connector on the cable. Improper installation could lead to poor electrical and mechanical connection between the compression connector and the cable.

Thus, there is a need in the field of corrugated coaxial cables for a universal connector that addresses the aforementioned problems.

SUMMARY

The present invention relates generally to the field of coaxial cable connectors and more particularly to a contact connector assembly for use with coaxial cables having a center conductor.

An aspect of the coaxial cable connector includes a coaxial cable having an inner conductor, an exposed outer corrugated conductor, an insulator positioned between the inner and outer conductors, and a protective jacket disposed over the corrugated outer conductor, a connector body comprising a first end, a second end, and an inner bore defined between the first and second ends of the body, a compression member comprising a first end, a second end, and an inner bore defined between the first and second ends, the first end of the compression member being structured to engage the second end of the connector body, a clamp ring comprising a first end, a second end, an inner bore defined between the first and second ends of the clamp ring for allowing the coaxial cable to axially pass therethrough, the clamp ring being structured to functionally engage the inner bore of the compression cap, a clamp comprising a first end, a second end, an inner bore defined between the first and second ends of the clamp for allowing the coaxial cable to axially pass therethrough, and an annular recess on the inner bore, the annular recess being structured to engage the outer corrugated conductor of the coaxial cable, the first end of the clamp ring being structured to functionally engage the second end of the clamp, and a compression surface positioned within the connector body, wherein the compression surface and the first end of the clamp are structured to crumple therebetween a corrugation of the outer conductor of the coaxial cable under the condition that the clamp is axially advanced into proximity of the compression surface.

Another aspect of the coaxial cable connector includes the compression surface being integral to the connector body and protruding radially inward from the inner bore of the connector body, the compression surface further comprising an oblique surface, and wherein the clamp further comprises an oblique surface, the oblique surface of the clamp being configured to compliment the oblique surface of the compression surface; wherein under the condition that the clamp is axially advanced toward the compression surface the oblique surface of the clamp and the oblique surface of the compression surface crumple therebetween the corrugation of the outer conductor of the cable.

Another aspect of the coaxial cable connector includes a notch positioned radially outward of the oblique surface, and wherein the first end of the clamp further comprises a protrusion positioned radially outward of the oblique surface of the clamp and extending axially from the first end of the clamp, wherein the notch and the protrusion are structurally configured to functionally engage therebetween a portion of the corrugation of the outer conductor under the condition that the oblique surface of the clamp and the oblique surface of the compression surface crumple therebetween the corrugation of the outer conductor.

Another aspect of the coaxial cable connector includes a compression ring having a first end, a second end, and an inner bored defined between the first and second ends of the compression ring, wherein the compression ring is structured to functionally engage the inner bore of the connector body and wherein the second end of the compression ring functions as the compression surface.

Another aspect of the coaxial cable connector includes the second end of the compression ring including an annular indentation, wherein under the condition that the clamp is axially advanced toward the compression surface the annular indentation engages a leading edge of the corrugation of the outer conductor of the cable, and wherein a portion of the corrugation deforms within the annular indentation and a remaining portion of the corrugation collapses between the compression surface and the clamp.

Another aspect of the coaxial cable connector includes the second end of the compression ring including an oblique surface and an opposing oblique surface that are structurally configured to form a v-shaped indention in the second end of the compression ring, and wherein the first end of the clamp comprises an outer beveled edge and an inner beveled edge, the beveled edges being configured to form a v-shape in the first end of the clamp that fits within the v-shaped indention of the compression surface, such that under the condition that the clamp is axially advanced toward the compression surface a corrugation of an outer conductor of the cable collapses between the v-shaped indention of the compression surface and the v-shape in the first end of the clamp.

Another aspect of the coaxial cable connector includes the clamp being comprised of a plurality of radially displaceable sectors, each sector being structured to independently radially displace under the condition that the coaxial cable passes through the clamp; and an elastic member positioned on an outer surface of the clamp, the elastic member being configured to maintain the relative position of the individual sectors with respect to one another during radial displacement of the individual sectors.

Another aspect of the coaxial cable connector assembly includes a deformable washer having a first end, a second end, and an inner bore defined between the first end and the second end, the deformable washer being positioned between the first end of the clamp and the second end of the connector body and being structured to slidably engage the inner bore of the compression cap.

Another aspect of the coaxial cable connector includes the deformable washer being structured to resist the axial advancement of the clamp under a first force and to deform under a second force greater than the first force to allow the clamp to axial advance through the deformed washer.

Another aspect of the coaxial cable connector includes an insulator having a first end, a second end, and an inner bore defined between the first and second ends of the insulator, the insulator positioned within the inner bore of the connector body and structured to slidably engage the inner bore of the connector body; and a conductive pin having a first end, a second end, and a flange extending radially outward from the pin in a central region of the pin, wherein the pin is positioned within and slidably engages the inner bore of the insulator, the flange is structured to engage the second end of the insulator, and the second end of the pin is structured to functionally engage a center conductor of the coaxial cable.

Another aspect of the coaxial cable connector includes the compression member functionally engaging the clamp ring to axially advance the clamp ring, the clamp ring functionally engaging the clamp to axially advance the clamp toward the compression surface, the clamp functionally engaging the coaxial cable to axially advance the coaxial cable toward the conductive pin, the connector body functionally engaging the insulator to axially advance the insulator, the insulator functionally engaging the conductive pin to axially advance the conductive pin toward the coaxial cable, wherein the axial advancement of the compression member and the connector body toward one another results in the corrugation of the outer conductor of the coaxial cable collapsing between the clamp and the compression surface, and the second end of the conductive pin functionally engaging the center conductor of the coaxial cable.

Another aspect of the coaxial cable connector includes a first insulator having a first end, a second end, a tubular cavity extending axially from the second end, and an inner bore defined between the first and second ends of the first insulator, the first insulator being positioned within the inner bore of the connector body and structured to slidably engage the inner bore of the connector body, and wherein the second end of the first insulator functionally engages the first end of the compression ring, a second insulator having a first end, a second end, and an inner bore defined between the first and second ends of the second insulator, the second insulator positioned within the inner bore of the connector body and structured to slidably engage the inner bore of the connector body, and a conductive pin having a first end and a second end, the second end defining an axial socket therein, wherein the pin is positioned within and slidably engages the inner bore of the second insulator, and wherein the second end of the pin is structured to functionally engage the first end of the first conductor and the axial socket is structured to functionally engage a center conductor of the coaxial cable.

Another aspect of the coaxial cable connector includes the second end of the first insulator including a tubular mandrel extending axially from the second end, wherein the tubular mandrel is structured to slidably engage the through hole of the compression ring such that the compression ring is positioned on and functionally engages the tubular mandrel of the first insulator.

Another aspect of the coaxial cable connector includes the deformable member having an inner bore and being positioned within the compression member between the second end of the compression member and the second end of the clamp ring.

Another aspect of the coaxial cable connector includes a shoulder on the inner bore of the connector body, a shoulder on the inner bore of the compression cap, a flange on the clamp ring, and a lip on the second end of the compression member that is structured to functionally engage the deformable member.

Another aspect of the coaxial cable connector includes, under the condition that one of the compression member and connector body are axially advanced toward the other, the compression member functionally engaging the clamp ring to axially advance the clamp ring, the clamp ring functionally engaging the clamp to axially advance the clamp toward the compression surface, the clamp functionally engaging the coaxial cable to axially advance the coaxial cable toward the conductive pin, the connector body functionally engaging the second insulator to axially advance the second insulator, the second insulator functionally engaging the conductive pin to axially advance the conductive pin toward the coaxial cable, the conductive pin functionally engaging the first insulator to axially advance the first insulator, the first insulator functionally engages the compression ring to axially advance the compression ring toward the clamp, wherein the axial advancement of the compression member and the connector body toward one another results in the corrugation of the outer conductor of the coaxial cable collapsing between the clamp and the compression surface, the socket of the conductive pin functionally engaging the center conductor of the coaxial cable, and the first insulator axially displacing the conductive pin through the bore of the second insulator such that the socket of the conductive pin functionally engages the inner bore of the second insulator and the second end of the second insulator functionally engages the first end of the first insulator.

Another aspect relates generally to compression connector, the connector comprising a connector body comprising a first end, a second end, and an inner bore defined between the first and second ends of the body, a compression member comprising a first end, a second end, and an inner bore defined between the first and second, the first end of the compression member being structured to engage the second end of the connector body, a clamp comprising a first end, a second end, an inner bore defined between the first and second ends of the clamp, wherein the clamp facilitates threadable insertion of a coaxial cable, and a compression surface disposed within the connector body, wherein axial advancement of one of the connector body and the compression member toward the other facilitates the clamp being axially advanced into proximity with the compression surface such that the clamp and the compression surface transmit force between one another.

Another aspect relates generally to connector comprising a connector body having a first end and a second end, a compression member configured to be axially compressed onto the connector body, a clamp disposed within the connector body, the clamp configured to facilitate threadable engagement with a coaxial cable, at least two cooperating surfaces, the cooperating surfaces configured to collapse one or more corrugations of an outer conductor of the coaxial cable therebetween when the connector moves into a closed position.

Another aspect relates generally to method of connecting a compression connector to a coaxial cable, the method comprising: providing a connector body having a first end and a second end, a compression member configured to be axially compressed onto the connector body, a clamp disposed within the connector body, the clamp configured to facilitate threadable engagement with a coaxial cable, at least two cooperating surfaces, the cooperating surfaces configured to collapse one or more corrugations of an outer conductor of the coaxial cable therebetween when the connector moves into a closed position, threadably advancing a coaxial cable into the connector body, wherein a spiral corrugated outer conductor of the coaxial cable threadably mates with a spiral grooved portion of an inner surface of the clamp, and axially compressing the compression member onto the connector body to move the connector to a closed position.

Another aspect relates generally to coaxial cable connector comprising a connector body configured to receive a coaxial cable, a compression member operably affixed to the connector body, a clamp configured to facilitate threadable engagement with the coaxial cable; and a cover disposed over at least a portion of the connector to seal the connector against environmental elements.

The foregoing and other features and advantages of the present invention will be apparent from the following more detailed description of the particular embodiments of the invention, as illustrated in the accompanying drawings.

BRIEF DESCRIPTION OF THE DRAWINGS

The features described herein can be better understood with reference to the drawings described below. The drawings are not necessarily to scale, emphasis instead generally being placed upon illustrating the principles of the invention. In the drawings, like numerals are used to indicate like parts throughout the various views.

DETAILED DESCRIPTION OF THE EMBODIMENTS

Figure 1:
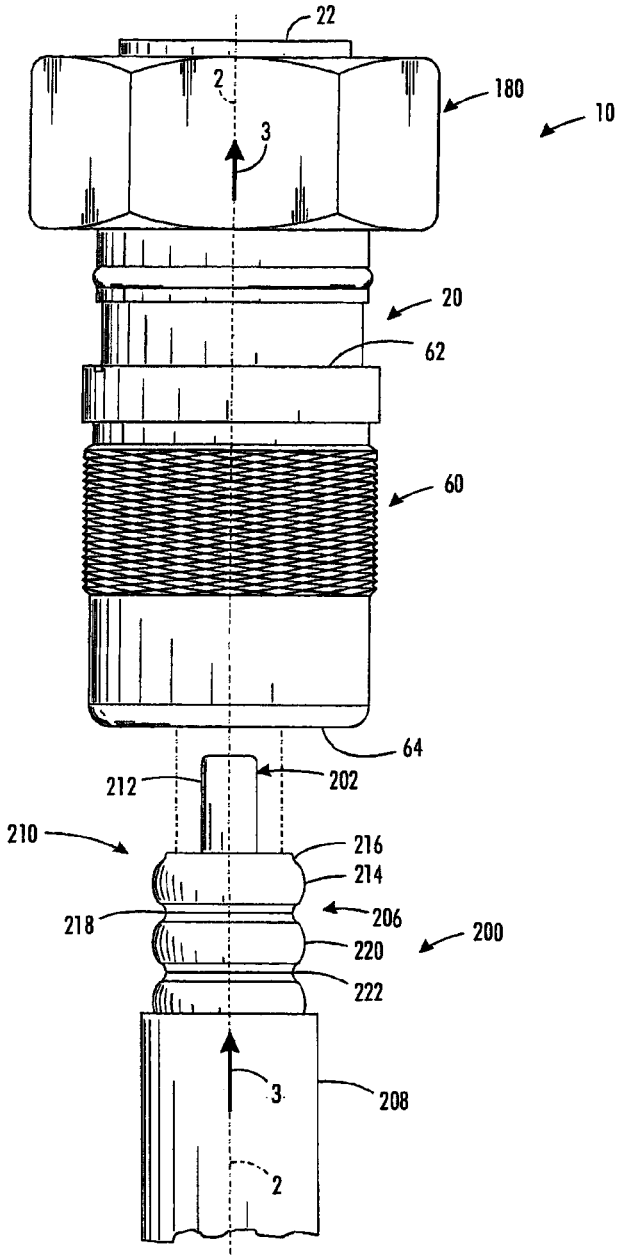
FIG. 1 is a side view of an embodiment of the connector in a first state, and a coaxial cable having a corrugated outer conductor, and an end prepared for insertion into the connector.
Figure 2:
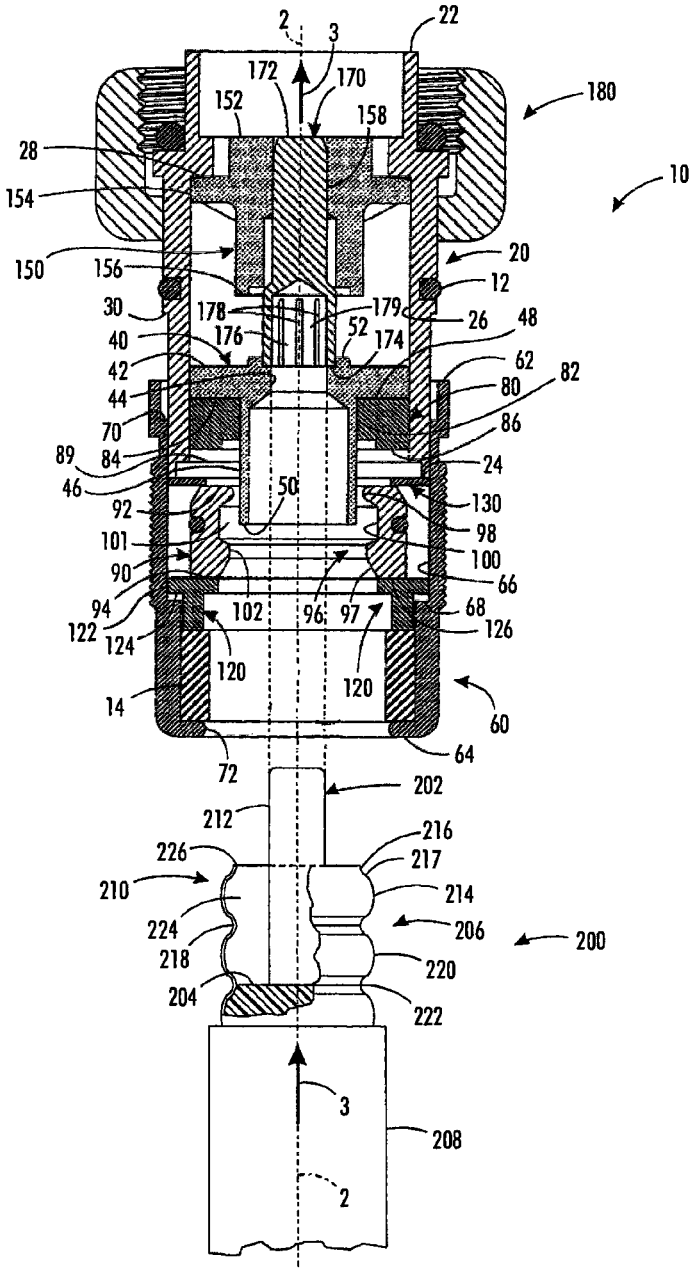
FIG. 2 is a side cross-sectional view of an embodiment of the connector in a first state, and a partial cut-away view of the prepared end of the coaxial cable.

Referring first to FIGS. 1 and 2, one embodiment of the connector 10 and an annularly corrugated coaxial cable 200 with a prepared end 210 are shown aligned on a common central axis 2. Since the connector 10 and the annularly corrugated coaxial cable 200 are generally axially symmetric about their central axis 2, the "radially outward" direction in the following description is considered to be outwardly away from the central axis 2. Conversely, "radially inward" with respect to connector component motion is considered to be inwardly toward the central axis 2. Moreover, "axial advancement" of the cable 200 with respect to the connector 10 and "axial advancement" of components of the connector 10 with respect to one another is considered to be along the length of the axis 2.

The coaxial cable 200 that may be coupled to the connector of the one embodiment is comprised of a solid center conductor 202 surrounded by an insulator 204, a corrugated outer conductor 206 surrounding the insulator 204, and an insulative jacket 208 surrounding the outer conductor 206. The prepared end 210 of the coaxial cable 200 is comprised of an exposed length 212 of the center conductor 202, an exposed length of the outer conductor 206 such that at least a first exposed outer conductor corrugation 214 between first and second recessed valleys 216 and 218 and a second exposed outer conductor corrugation 220 between second and third recessed valleys 218 and 222 are exposed. The leading edge 226 of the exposed outer conductor 206 should be configured (i.e. cut) such that the leading edge 226 is part of one the recessed valleys of the corrugated outer conductor 206, the advantages of which will be described in detail below. The insulator 204 is made of a soft, flexible material, such as a polymer foam. A portion of the insulator 204 may be removed from the prepared end 210, thereby providing a "cored out" annular cavity 224 for receiving a portion of a component of the connector 10.

FIG. 2 depicts a cross-sectional view of an embodiment of the connector 10 in a first state. The connector 10 is comprised of a tubular connector body 20 comprising a first end 22, a second end 24, and an inner bore 26. The connector body 20 is comprised of a conductive material. The connector 10 is further comprised of a first insulator 40 is disposed within the inner bore 26 of the tubular connector body 20. The first insulator 40 is comprised of a first surface 42, a second surface 48, a through hole 44, and a tubular mandrel 46 extending axially from the second surface 48 of the first insulator 40. The connector 10 is further comprised of a compression member 60 comprising a first end 62, a second end 64, and an inner bore 66 having a central shoulder 68. The compression member 60 is configured to couple to the tubular connector body 20, and more specifically to slidably engage the second end 24 of the body 20.

The connector 10 is further comprised of means for collapsing the first exposed corrugation 214 of the outer conductor 206 of the coaxial cable 200 in the axial direction when the compression member 60 engages the connector body 20 and is axially advanced further toward the connector body 20. The particular components of the connector 10 and the means for collapsing the outer conductor are described herein below.

The connector 10 is further comprised of a conductive compression ring 80 that comprises a first surface 84 that engages the second surface 48 of the first insulator 40, and a second surface 86 that functions as a compression surface that assists in the collapsing of the first exposed corrugation 214 of the outer conductor 206 of the coaxial cable 200. The compression ring 80 comprises a through hole 82 that engages the tubular mandrel 46 of the first insulator 40, such that the tubular mandrel 46 fits within and slidably engages the through hole 82.

The connector 10 is further comprised of an expandable clamp 90 that is structured to slide within the connector 10 and functionally engage the inner bore 26 of the connector body 20. The clamp 90 comprises a first end 92, a second end 94, a central passageway 96, and a central annular recess 100 defined between a first protruded edge 98 that extends radially inward proximate the first end 92 and a second protruded edge 102 that extends radially inward proximate the second end 94. The first end 92 of the clamp 90 functions as another compression surface that assists in the collapsing of the first exposed corrugation 214 of the outer conductor 206 of the coaxial cable 200, under the condition that the compression surface, mentioned above, is brought into proximity with the first end 92 of the clamp 90, as one of the compression member 60 and the connector body 20 is axially advanced toward the other.

The connector 10 is further comprised of a clamp push ring 120 that is comprised of a flange 122 having an outer shoulder 124 that is structurally configured to slidably engage the inner bore 66 of the compression member 60 and functionally engage the central shoulder of 68 of the compression member 60. The clamp push ring 120 further comprises a first end 126 that is structured to functionally engage the second end 94 of the expandable clamp 90.

In other embodiments, the compression member 60 is structured to functionally engage the clamp 90 directly, such that axial advancement of the compression member 60 results in the axial advancement of the clamp 90.

Figure 4:
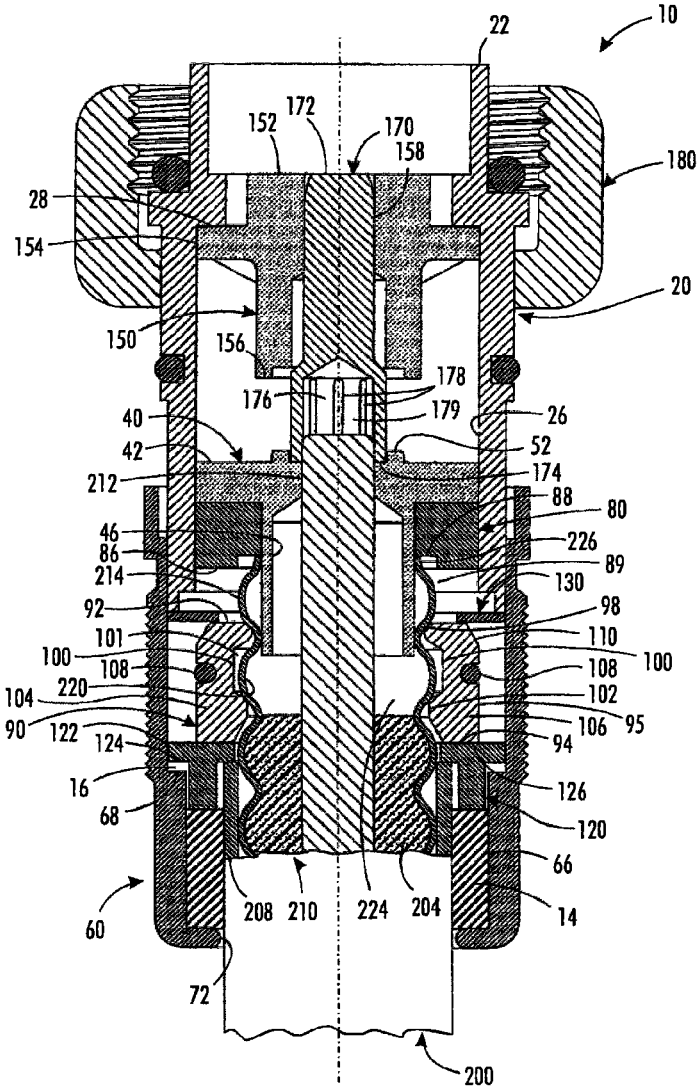
FIG. 4 is a side cross-sectional view of an embodiment of the connector in a first state, with the prepared end of the coaxial cable inserted therein.

The prepared cable end 210 is disposable in the connector 10, and is shown disposed within the connector 10 in FIG. 4, the connector 10 and the cable 200 being in a first state. Referring to FIGS. 2 and 4, under the condition that the prepared cable end 210 is inserted into the connector 10, the exposed first corrugation 214 of the cable end 210 is disposed within an annular volume 89 formed between the first end 92 of the expandable clamp 90 and the second surface 86 of the compression ring 80. Additionally, the second exposed corrugation 220 is disposed within the central annular recess 100 of the expandable clamp 90, and the tubular mandrel 46 extends axially within the annular cavity 224.

Figure 3:
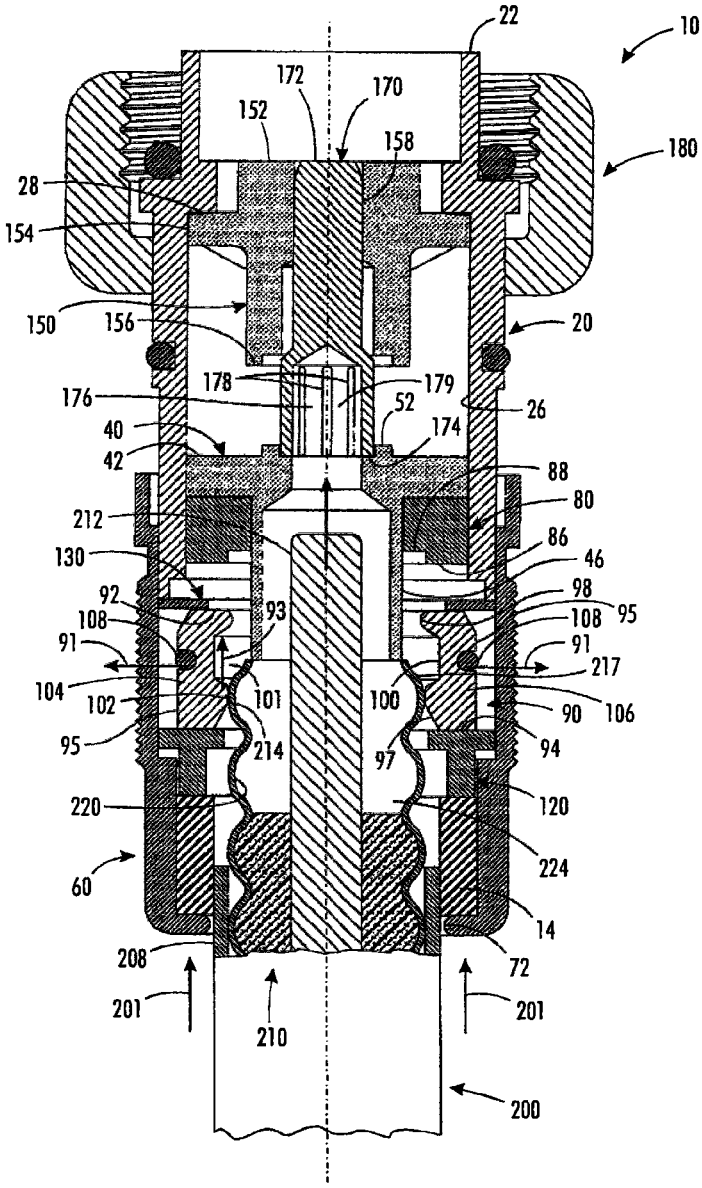
FIG. 3 is a side cross-sectional view of an embodiment of the connector in a first state, with the prepared end of the coaxial cable inserted therein.

To reach the first position disclosed in FIG. 4, the prepared cable end 210 is inserted into the inner bore 66 of the compression member 60 until the leading edge 226 of the corrugated outer conductor 206 engages the expandable clamp 90, as shown in FIG. 3. Upon engagement, the cable 200 is further axially advanced through the central passageway 96 so that the expandable clamp 90 expands radially outward to allow the first exposed corrugation 214 of the cable 200 to pass through the central passageway 96 of the clamp 90, and then contracts radially inward to contain the second exposed corrugation 220 of the cable 200 within the central annular recess 100 of the clamp 90. More specifically, as the first exposed corrugation 214 of the coaxial cable 200 engages the second protruded edge 102 of the expandable clamp 90, the angled first portion 217 of the first exposed corrugation 214 engages the angled second portion 97 of the second protruded edge 102 of the expandable clamp 90. This provides a camming action, wherein the first exposed corrugation 214 acts as a cam lobe, and the second protruded edge 102 of the expandable clamp 90 acts as a cam follower, thereby radially expanding the expandable clamp 90, as indicated in FIG. 3 by arrows 91.

The insertion of the cable end 210, as described above, also provides an axial force against the expandable clamp 90, as indicated by arrow 93. However, a deformable washer 130 is positioned, in the first state, within the connector 10 between the second end 24 of the conductive tubular body 20 and the first end 92 of the expandable clamp 90, such that the deformable washer 130 engages the first end 92 of the expandable clamp 90 and engages the second end 24 of the tubular connector body 20. The deformable washer 130, being engaged by the tubular connector body 20, resists the axial force 93 and prevents the expandable clamp 90 from being advanced axially by the inserted cable end 210. The deformable washer 130 also acts as a bearing against which the first end 92 of the expandable clamp 90 slides as the expandable clamp 90 radially expands and contracts as exposed corrugations 214 and 220 pass through the second protruded edge 102, as described above.

To allow the expandable clamp 90 to radially expand and contract, the expandable clamp 90 may be comprised of a plurality of sectors, for example sectors 104 and 106, that individually radially displace in relation to one another as the corrugated cable 200 passes therethrough. The plurality of sectors collectively comprise the expandable clamp 90, including the central annular recess 100, the first protruded edge 98, and the second protruded edge 102. To hold the individual sectors of the expandable clamp 90 in relative proximity to one another, the expandable clamp 90 may be further comprised of an elastic member 108 disposed around the radially displaceable sectors 104/106, thereby retaining the relative position of the sectors 104 and 106 with respect to one another, including during the radial expansion and contraction capability when the corrugation 214 and/or 220 of the prepared cable end 210 passes through and/or into the clamp 90. In one embodiment depicted in FIGS. 3 and 4, the elastic member 108 may be formed as an elastic ring. The elastic ring 108 may have a circular cross-section as shown in FIGS. 3 and 4, or the elastic member 108 may have a square, rectangular, or other cross sectional shape. The expandable clamp 90 may be provided on its outer periphery 95 with a correspondingly shaped groove which engages and the elastic member 108 and maintains the relative position of the elastic member 108 in relation to the clamp 90. The elastic member 108 may be made of an elastomer such as a rubber. In one embodiment, the elastic ring may be made of rubber or a rubber-like material. Alternatively, the elastic member 108 may be formed as a toroidal spring, such as a wound metal wire spring commonly used in lip seals. In another embodiment (not shown), the elastic member 108 may be formed as an elastic sleeve, which encloses a portion of the outer periphery 95 of the expandable clamp 90. The elastic sleeve may also be made of an elastomer such as a rubber.

Referring again to FIG. 4, the prepared cable end 210 and the connector 10 are shown in the first state. The expandable clamp 90 has expanded radially to allow the first exposed corrugation 214 of the cable 200 to pass therethrough, and then contracted radially to contain the second exposed corrugation 220 of the cable 200 within the central annular recess 101 of the clamp 90. The exposed first corrugation 214 of the cable end 210 is disposed within the annular volume 89 formed between the first end 92 of the expandable clamp 90 and the second surface 86 of the compression ring 80, and the tubular mandrel 46 extends axially within the annular cavity 224. The expandable clamp 90 of the connector 10 retains the cable 200 in place. Thereafter, under the condition that the compression member 60 is axially advanced, the cable 200 advances therewith due to the structural engagement of the expandable clamp 90, the compression member 60, and the outer conductor 206.

In the first state, the connector 10 and cable 200 are positioned for the compression member 60 and the tubular connector body 20 to be further axially advanced toward one another. This is achieved by one of the following: the compression member 60 being axially advanced toward the connector body 20 as the connector body 20 is held in place; the connector body 20 being axially advanced toward the compression member 60 as the compression member 60 is held in place; or each of the compression member 60 and connector body 20 being axially advanced toward one another concurrently. The axial advancement of the compression member 60 and the connector body 20 towards one another results in the compression member 60 and the connector body 20 reaching a second state, wherein the cable 200 within the compression member 60, the compression member 60, and the connector body 20, are sufficiently coupled mechanically and electrically to allow the cable 200 to pass its signal through the connector 10 to the port (not shown) to which the connector 10 is attached. In other words, in the second state, as shown in FIG. 5, the connector 10 establishes the desired operational electrical and mechanical connections between the cable 200, the connector 10, and the port (not shown).

Figure 5:
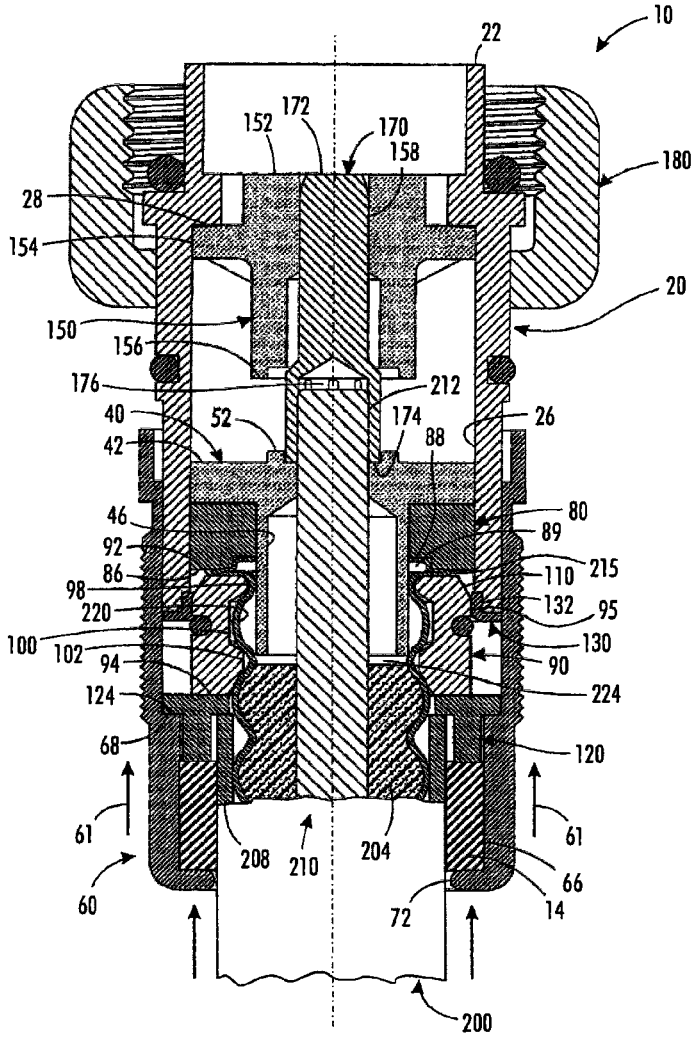
FIG. 5 is a side cross-sectional view of an embodiment of the connector.

In the embodiment shown in FIGS. 4 and 5, the compression member 60 and the tubular connector body 20 are structured to slidably engage one another and move in an opposing axial direction with respect to one another from the first state of FIG. 4 to the second state of FIG. 5. The axial movement of the compression member 60 toward the connector body 20 results in the collapsing of the first exposed corrugation 214 of the outer conductor 206 of the coaxial cable 200 between the a compression surface, the first end 92 of the expandable clamp 90, and another compression surface, the second surface 86 of the conductive compression ring 80, as shown in FIG. 5. The axial advancement of the compression member 60 toward the connector body 20 facilitates the expandable clamp 90 moving axially within the inner bore 26 of the tubular connector body 20 toward the conductive compression ring 80. This axial displacement of the expandable clamp 90 results in the expandable clamp 90 deforming an inner region 132 of the deformable washer 130, such that the expandable clamp 90 axially advances past the washer 130 through the deformed inner region 132 of the washer 30 toward the compression ring 80. Moreover, this axial advancement of the expandable clamp 90 reduces the annular volume 89 between the first end 92 of the expandable clamp 90 and the second surface 86 of the compression ring 80. The reduction of the annular volume 89 results in the first exposed corrugation 214 of the outer conductor 206 of the coaxial cable 200 collapsing between the compression surfaces, or between the first end 92 of the expandable clamp 90 and the second surface 86 of the conductive compression ring 80. In this second state, the compression surfaces, described above, collapse the first exposed corrugation 214 into a collapsed corrugation 215, the collapsed corrugation 215 being defined as the entire section of the first exposed corrugation 214 that has been folded upon itself, or buckled upon itself, to create a double thickness of the outer conductor 206. Specifically, in one embodiment, the collapsed corrugation 215 comprises two thicknesses of the outer conductor 206 in at least a portion of the collapsed corrugation 215. In another embodiment, the collapsed corrugation 215 comprises two thicknesses of the outer conductor 206 in a majority of the collapsed corrugation 215. In yet another embodiment, the collapsed corrugation 215 comprises two thicknesses of the outer conductor 206 in the entirety of the collapsed corrugation 215. The compression surfaces further press the collapsed corrugation 215 therebetween to facilitate a functional electrical connection between the corrugated outer conductor 206 of the cable 200 and the tubular connector body 20. The tubular mandrel 46 extends axially into the annular cavity 224, thereby insulating the corrugated outer conductor 206 from the central conductor 202.

The compression ring 80, against which the collapsed corrugation 215 is pressed in the second state, may further comprise an annular recess 88 in the second surface 86, the annular recess 88 being structured to receive the leading edge 226 of the first exposed corrugation 214, as shown in FIG. 4. Under the condition that the connector 10 is transitioned from the first state to the second state, the leading edge 226 enters the annular recess 88. The axial movement of the compression surfaces, 92 and 86, toward one another results in the leading edge 226 engaging the annular recess 88 and buckling within the annular recess 88 to assume the shape of the annular recess 88. The remaining portion of the collapsed corrugation 215 is compressed between the compression surfaces, 92 and 86, such that the collapsed corrugation 215 is buckled on itself between the compression surfaces 92 and 86. This two-stage buckling of the collapsed corrugation 215 enhances the electrical and mechanical connections between the corresponding components of the connector 10.

The expandable clamp 90 may be further comprised of a beveled edge 110 proximate the first end 92, which facilitates displacement of the deformable washer 130 when the compression member 60 is axially advanced toward the connector body 20, as explained above.

Also, the inner region 132 of the deformable washer 130 may be provided with score marks, slits, or other stress-concentrators (not shown) to facilitate the deformation of the washer 130. The deformable washer 130 is made of a material that is sufficiently rigid to serve as a stop for the expandable clamp 90 when the prepared end 210 of a corrugated cable 200 is inserted into the connector 10, but is also sufficiently flexible so as to deform when the expandable clamp 90 is axially advanced toward the tubular connector body 20 during transition between the first and second states of the connector 10. The deformable washer 130 may be made of a thin, soft metal, a plastic, or other like material that allows the washer 130 to perform its function described above.

Referring again to FIG. 2, the cable connector 10 may be further comprised of a second insulator 150 disposed within the inner bore 26 of the tubular connector body 20 firstly from the first insulator 40. The second insulator 150 may be comprised of a first end 152, a second end 156, a central through-bore 158, and a flange 154 that is structurally configured to slidably engage the inner bore 26 of the tubular connector body 20 and configured to engage a shoulder 28 on the inner bore 26 of the tubular connector body 20. The connector 10 may further include a conductive central pin 170 disposed within the central through-bore 158 of the second insulator 150. The conductive central pin 170 may be comprised of a first end 172, a second end 174, and an axial socket 176 extending axially from the second end 174.

Referring also to FIGS. 4 and 5, when the coaxial cable 200 is inserted into the connector 10, the axial socket 176 of the central pin 170 receives the exposed tip 212 of the center conductor 202 of the cable 200. A plurality of slits 178 running axially along the length of the socket 176 may be cut into the central pin 170 at predetermined intervals in the socket 176, thereby defining a plurality of fingers 179 between the slits 178 which are structurally configured to expand when the exposed tip 212 of the prepared cable 210 is inserted into the axial socket 176.

Figure 6:
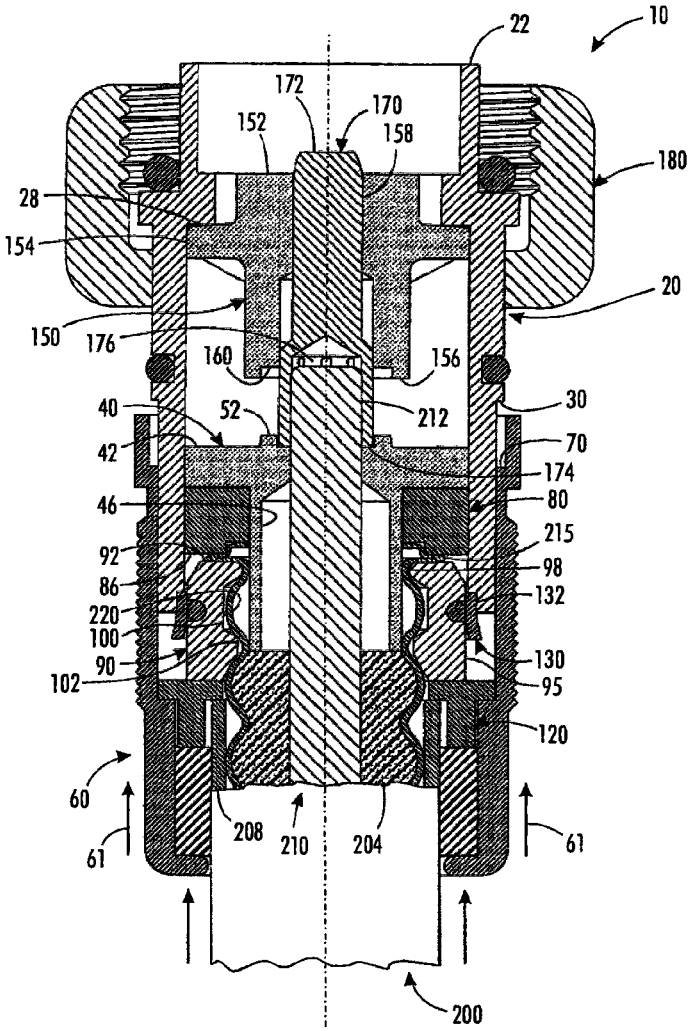
FIG. 6 is a side cross-sectional view of an embodiment of the connector.
Figure 7:
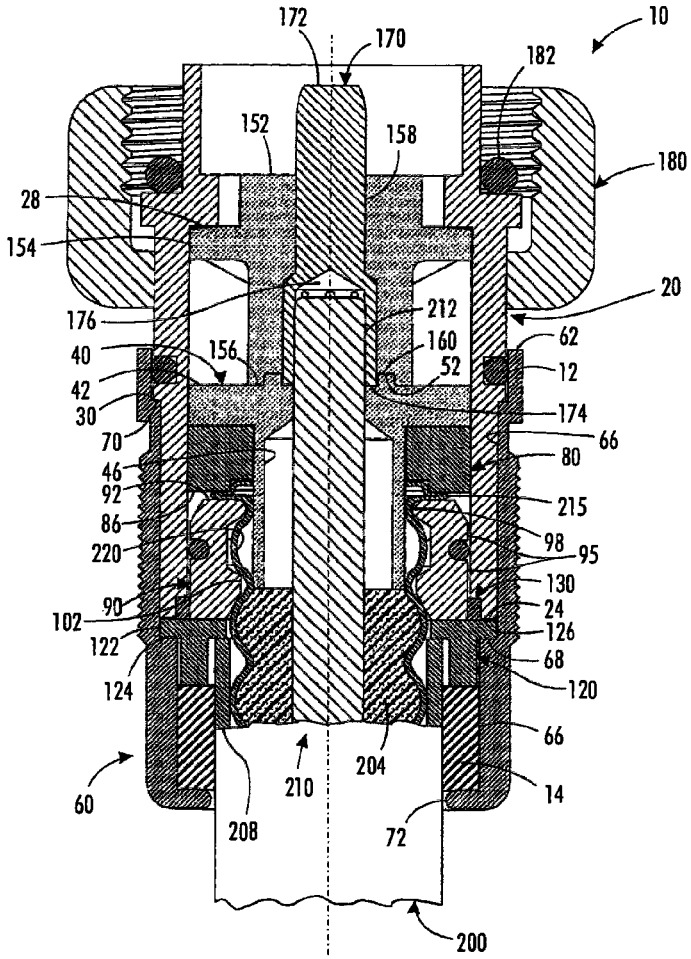
FIG. 7 is a side cross-sectional view of an embodiment of the connector.

The first surface 42 of the first insulator 40 may further comprise an annular rim 52 extending axially from the first surface 42, the annular rim 52 defining an annular hollow that is structured to receive the second end 174 of the central pin 170 under the condition that the compression member 60 is axially advanced toward the tubular connector body 20 from the first state to the second state. Referring to FIG. 6, axial advancement of the compression member 60 toward the connector body 20 to the second state results in the first surface 42 of the first insulator 40 engaging the second end 174 of the conductive central pin 170, as well as axially displacing the conductive central pin 170 within the through-bore 158 of the second insulator 150. Referring also to FIG. 7, axial advancement of the compression member 60 toward the connector body 20 to the second state results in the first surface 42 of the first insulator 40 engaging the second end 156 of the second insulator 150. The second end 156 of the second insulator 150 may further comprise an annular recess 160 that is structured to receive the annular rim 52 of the first insulator 40.

The second state, shown in FIG. 7, is the configuration in which the connector 10 and the cable 20 are mechanically and electrically coupled. Specifically, in the second state, the connector 10 is electrically and mechanically coupled to the cable 200 to allow the cable 200 to transmit signals through the connector 10 and to the port (not shown) to which the connector 10 is further coupled. In the second state, the central pin 170 has been axially advanced beyond the first end 152 of the second insulator 150, so that the central pin 170 is connectable to a central socket of the port (not shown). Additionally, at least a portion of the deformable washer 130 is compressed and contained between the clamp push ring 120, the expandable clamp 90, and the tubular connector body 20. Some other portion of the deformable washer 130 may be disposed as shavings or other small particles (not shown) between the expandable clamp 90 and the tubular connector body 20.

The connector 10 may be further configured such that axial advancement of the compression member 60 to the second state results in the first end 126 of the clamp push ring 120 engaging the second end 24 of the tubular connector body 20. Also, axial advancement of the compression member 60 to the second state results in a first shoulder 70 on the inner bore 66 of the compression member 60 to engage an outer shoulder 30 on the tubular connector body 20. These contacts between the respective parts may function as additional stops when axially advancing the member 60 onto the tubular connector body 20.

It is to be understood that the order of the movement of the parts within the connector 10, and the collapse of the outermost corrugation 214 of the prepared cable end 210 may vary from that described above and depicted in FIGS. 4-7. For example, the first insulator 40 and conductive compression ring 80 have interference fits within the inner bore 26 of the tubular connector body 20. Therefore, axial advancement of these parts 40 and 80 within the bore 26 of the tubular connector body 20 is resisted by friction therewith. If this frictional force of resistance to motion of the first insulator 40 and conductive compression ring 80 is less than the force required to collapse the outermost exposed corrugation 214 of the coaxial cable 200, then the first insulator 40 and conductive compression ring 80 may axially advance within the bore 26 of the tubular connector body 20 before the outermost exposed corrugation 214 of the coaxial cable 200 collapses.

Additionally, for example, axial advancement of the compression member 60 toward the connector body 20 may first cause the first surface 42 of the first insulator 40 to engage the second end 174 of the conductive central pin 170 and axially advance the conductive central pin 170 within the through-bore 158 of the second insulator 150. The compression member 60 may be further advanced axially on the tubular connector body 20 to result in the first surface 42 of the first insulator 40 engaging the second end 156 of the second insulator 150. The compression member 60 may be further advanced axially on the tubular connector body 20 to result in the expandable clamp 90 axially advancing within the inner bore 26 of the tubular connector body 20 toward the conductive compression ring 80, thereby reducing the annular volume 89 between the first end 92 of the expandable clamp 90 and the second surface 86 of the compression ring 80, and collapsing the first exposed corrugation 214. Further, for example, if the frictional resistance to motion of the first insulator 40 and conductive compression ring 80 within the tubular connector body 20 is approximately equal to the force required to collapse the outermost exposed corrugation 214, the displacement of these internal components 40 and 80 within the tubular connector body 20 and the collapse of the first most corrugation 214 of the cable 200 may occur concurrently as the compression member 60 is axially advanced toward the connector body 20 from the first state to the second state.

Referring again to FIGS. 2 and 7, the connector 10 may include a first seal 12, such as an O-ring, that is disposed within a groove 13 (labeled in FIG. 8) on the outer periphery of the connector body and resides between the tubular connector body 20 and the inner bore 66 of the compression member 60 under the condition that the connector 10 is in the second state. The connector 10 may further include a second seal 14 that is contained within the inner bore 66 and a second flange 72 of the compression member 60. Referring also to FIGS. 4 and 5, the components of the connector 10 may be dimensioned such that prior to the member 60 being axially advanced toward the tubular connector body 20 there is a small gap 16 between the outer shoulder 124 of the clamp push ring 120 and the central shoulder 68 of the compression member 60. When the compression member 60 is axially advanced toward the connector body 20 the gap 16 is eliminated. The removal of the gap 16 places the second seal 14 in an axially compressed condition, thereby causing a radial expansion of the seal 14 that in turn provides effective sealing between the jacket 208 of the cable 200 and the inner bore 66 of the compression member 60. With the compression member 60 sealed at one of its ends to the tubular connector body 20 by the seal 12, and sealed at the other of its ends to the cable 200 by the seal 14, moisture is prevented from entering the mechanically and electrically coupled connector 10 and cable 200, thereby preserving the electrical and mechanical connection between the connector and the cable.

Referring to FIGS. 1 and 7, the connector 10 may be provided with a fastener 180, such as a nut for engagement to the port (not shown). The fastener 180 may include a seal 182 for sealing to the port. Alternatively, the connector 10 may be provided with male threads for connection to a female port. The connector 10 may also be configured as an angled connector, such as a 90 degree elbow connector.

Figure 8:
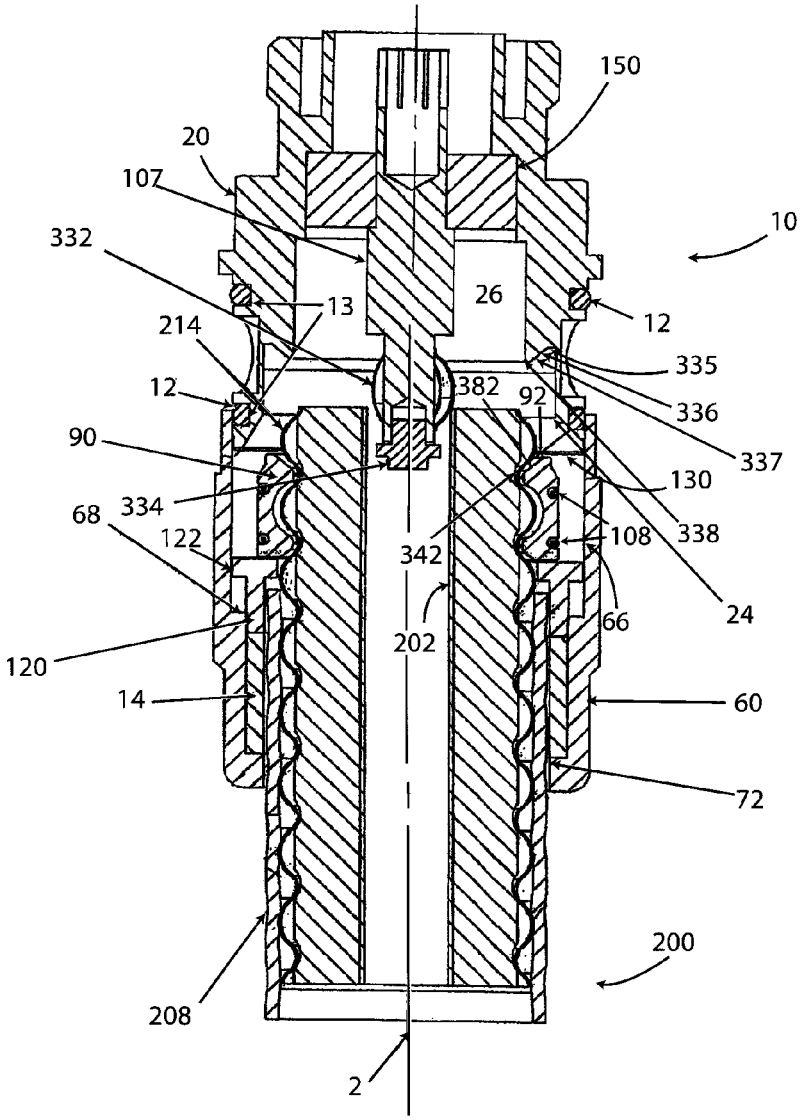
FIG. 8 is a cross sectional view of an embodiment of the connector, with the prepared end of the coaxial cable inserted therein.

Referring to FIG. 8, another embodiment of the connector 10 and the annularly corrugated coaxial cable 200 with the prepared end 210 are shown aligned on a common central axis 2. FIG. 8 is a cross sectional view of the exemplary compression connector 10 during insertion of the prepared segment 210 of annular corrugated coaxial cable 200. The coaxial cable 200 of one embodiment is comprised of a hollow center conductor 202 surrounded by an insulator 204, a corrugated outer conductor 206 surrounding the insulator 204, and an insulative jacket 208 surrounding the outer conductor 206. The prepared end 210 of the coaxial cable 200 is comprised of an exposed length of the center conductor 202, the insulator 204, and the corrugated outer conductor 206. The outer conductor 206 is exposed by removing the insulative jacket 208 around the conductor 206 until at least a first exposed outer conductor corrugation 214 between first and second recessed valleys 216 and 218 and a second exposed outer conductor corrugation 220 between second and third recessed valleys 218 and 222 are exposed. The prepared end 210 should be configured (i.e. cut) such that the leading edge 226 of the outer conductor 206 is within one of the recessed valleys of the corrugated outer conductor 206, the advantages of which will be described in detail below. The insulator 204 is made of a soft, flexible material, such as a polymer foam.

The connector 10 of the various embodiments described herein is advantageous in that it is simple to install in a factory or field setting and it is reliably effective at establishing and maintaining strong contact forces between the connector 10 and the annular corrugated coaxial cable 200.

The connector 10 of one embodiment includes the conductive pin 170 and the insulator 150, the insulator 150 being disposed within the connector body 20 and slidably engaged with the inner bore 26 of the connector body 20. The insulator 150 is disposed around the conductive pin 170 so as to hold the conductive pin 170 in place. Further, the insulator 150 is positioned radially between the conductive pin 170 and the connector body 22. The conductive pin 170 provides the connection to the hollow center conductor 202 of the prepared coaxial cable segment 210 to which the connector 10 is being connected, and the insulator 150 electrically insulates the conductive pin 170 from the connector body 22 and the connector body 20. In the disclosed embodiment, the conductive pin 170 may have outwardly expanding flexible tines 332 to engage the inner diameter of the hollow conductor 202, and a retaining element 334 to secure the tines 332 from axial movement.

Figure 11:
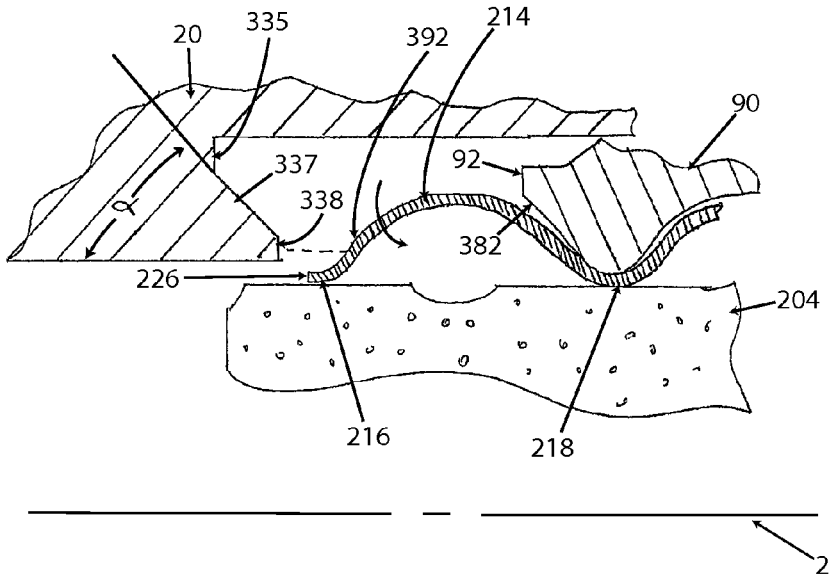
FIG. 11 is an enlarged view of an embodiment of the connector.

In one embodiment, the inner bore 26 of the connector body 20 further comprises an engagement region 336, shown in FIG. 8 and enlarged in FIG. 11. The engagement region 336 comprises a first region 335 that extends radially inward from the inner bore 26 of the connector body 20 and a second region 337 that extends both radially inward and axially toward the prepared end 210 of the coaxial cable 200. The engagement region 336 functions as a compression surface, similar to the compression surfaces 92 and 86 in embodiments described above, in that the engagement region 336 assists in the collapse of the corrugated outer conductor 214. In one embodiment, second region 337 has an acute angle $\alpha$ from the longitudinal axis 2. The angle may be between 5 degrees and 60 degrees. In the disclosed embodiment, the angle of the second region 337 is approximately 45 degrees. The proximal end of the engagement region 336 may further include a planar face 338 substantially perpendicular to the longitudinal axis 2. The planar face 338 and the engagement region 336 work in concert to engage and deform the corrugated outer conductor 214 until it collapses on itself to form the collapsed corrugated outer conductor 215, under the condition that the connector is transitioned from the first state, shown in FIG. 8, to the second state, shown in FIG. 9.

In one embodiment, the second end 24 of the connector body 20 further comprises a beveled edge 342 to assist in the functional engagement of the connector body 20 with the clamp 90 as the connector 10 transitions from the first state to the second state. More specifically, the beveled edge 342 permits the clamp 90 to slidably engage the beveled edge 342 so as to ensure that the outer periphery 95 of the clamp 90 slidably engages the inner bore 26 of the connector body 20 under the condition that the compression member 60 is axially advanced toward the connector body 20 from the first state to the second state. For example, transition from the first state to the second state results in the advancement of the compression member 60 so that the shoulder 68 of the compression member 60 engages the clamp push ring 120, which engages the clamp 90, which engagement axially advances the clamp 90 toward the connector body 20, such that the clamp 90 engages the beveled edge 342 of the connector body 20 to guide the outer periphery 95 of the clamp 90 to slidably and functionally engage the inner bore 26 of the connector body in the second state.

Figure 9:
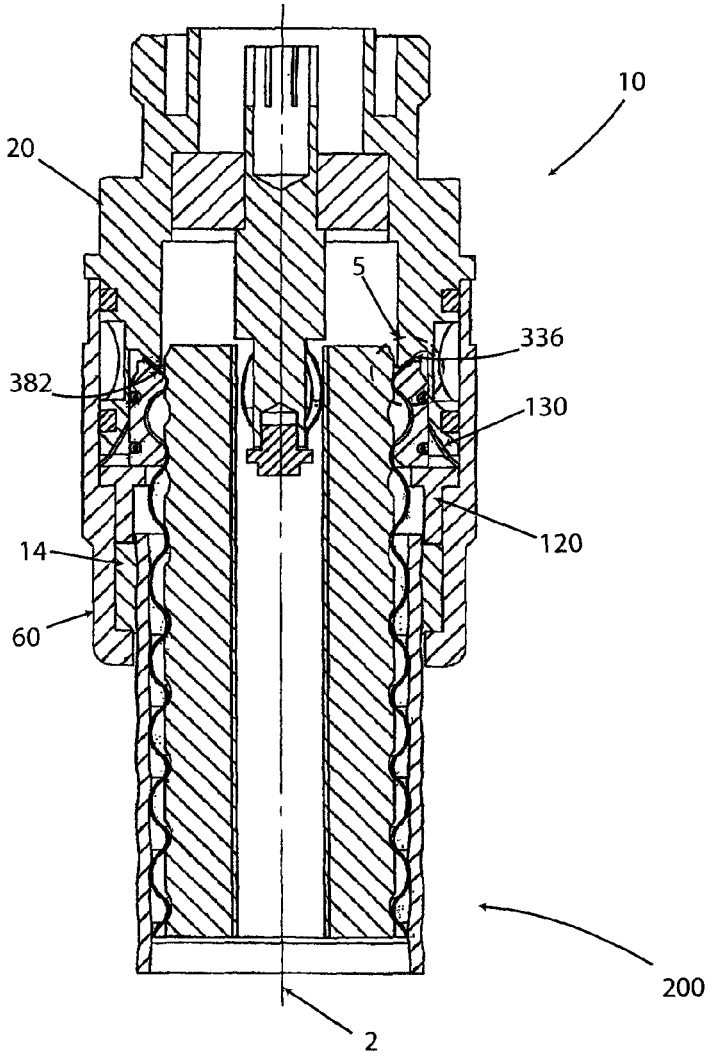
FIG. 9 is a cross sectional view of an embodiment of the connector.

In one embodiment, the clamp 90 may also have a beveled edge 382 on the first end 92. The beveled edge 382 functions as a compression surface, similar to the compression surfaces 92 and 86 in the embodiments described above. Moreover, the beveled edge 382 is structurally compatible with the engagement region 336, such that the beveled edge 382 and the engagement region 336 work in concert to engage and deform the corrugated outer conductor 214 under the condition that the connector is transitioned from the first state to the second state. In addition, the clamp 90 may have a plurality of elastic members 108 disposed around the outer periphery 95 thereof, as shown in FIGS. 8 and 9. The elastic members 108 may be tension rings that serve to hold the individual sectors of the clamp 90 in a slightly open or expanded position. The tension rings may be fabricated from metal or plastic.

In one exemplary operation, the connector 10 of the various embodiments may be joined to the coaxial cable segment 200 generally in the following manner. The corrugated coaxial cable segment 200 may be prepared for insertion by cutting the cable at one of the corrugation valleys, and specifically at the first corrugation valley 216, or at least near the first corrugation valley 216. This offers an advantage over many prior art cable connectors that require cutting the corrugation at a peak, which can be difficult. After the cable 200 has been cut at any of the corrugation valleys to expose the first corrugation valley 216, the cable 200 can be prepared according to the respective descriptions provided above.

The connector 10 is thereafter pre-assembled to its first state. The internal elements 14, 120, 90, and 130 may be held in axial compression by inserting the seal 14 into the bore 66 of the member 60 until it abuts the second flange 72; inserting the plush clamp ring 120 into the bore 66 of the member 60 until it abuts with the seal 14; inserting the clamp 90 until it abuts with the clamp push ring 120; and inserting the washer 130 into the bore 66 of the member 60 until it abuts with the clamp 90. The internal elements 150 and 170 can also be held in axial compression by inserting the insulator 150 into the bore 26 of the connector body 20 until the insulator abuts the shoulder 28 on the inner bore 26; inserting the conductive pin 170 into the central through-bore 158 of the insulator 150. In the case of the embodiments described above, the first insulator 40 may be inserted within the bore 26 of the connector body 20 and thereafter the compression ring 80 may be inserted onto the tubular mandrel 46 of the first insulator 40. The compression member 60 and the connector body may thereafter be initially coupled together by slidably engaging the compression member 60 with the body 20 to establish the first state of the connector 10. In the embodiments shown, the bore 66 of the member 60 slidably engages the outer periphery of the connector body 20, until the washer 130 engages not only the clamp 90 within the compression member 60 but also engages the second end 24 of the connector body 22, thus holding the respective components in place in the first state.

In the disclosed embodiments, the insertion of the coaxial cable 200 to the first state may be performed by hand. The corrugated coaxial cable 200 is the annular variety, although the invention is not so limited. The annular corrugations in the outer conductor 206 do not allow the clamp 90 to be threaded into place, as may be the case for spiral corrugated coaxial cable segments. Therefore, the individual sectors of the clamp 90 must spread radially outward to allow the clamp 90 to clear the corrugated sections of the outer conductor 206 in the coaxial cable 200. In one embodiment, the elastic member 108 is flexible and allows the clamp 90 to spread radially outward while constraining individual sectors of the clamp 90 from becoming free. As the cable 200 is pushed into the connector 10 through the compression member 60, the clamp 90 extends radially outward to clear the corrugated peaks and valleys of the outer conductor 206, then settles radially inward into the corrugated valleys.

In the embodiments herein described, the transition of the connector 10 from the first state to the second state may be performed by hand or in most cases by a hydraulic tool (not shown). The tool engages the member 60 and the connector body 20 and squeezes them together, thereby moving the connector 10 to the second state. As the hydraulic tool axially displaces the member 60 and the body 20 together, the shoulder 68 on the member bore 66 engages the flange 122 of the clamp push ring 120. Further axial advancement of the member 60 and body 20 toward one another results in the clamp push ring 120 engaging the clamp 90. Because the clamp 90 is engaged with the outer conductor 206 of the cable 200, the cable 200 will also travel axially towards the connector body 20 as the clamp 90 travels axially towards the connector body 20. As noted above, the washer 130 is designed flexible enough that the clamp 90 pushes through the washer 130. Further advancement of the member 60 results in the clamp 90 and cable 200 approaching the connector body 20.

Figure 10:
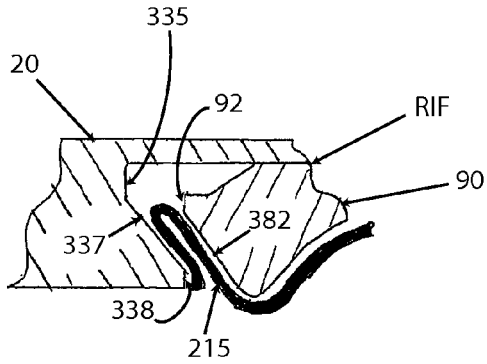
FIG. 10 is an enlarged view of an embodiment of the connector of FIG. 9.

In the another embodiment, as shown in FIG. 9, the leading edge 226 of the first exposed outer conductor corrugation 214 encounters the engagement region 336 of the connector body 20 and is deformed in a manner that provides superior electrical contact. Recalling that the outer conductor 206 has been trimmed at the corrugation valley 216, in one embodiment the planar face 338 and the engagement region 336 cause the outer conductor 214 to fold upon itself and become wedged between the engagement region 336 of the connector body 20 and the clamp engagement region 382 of the clamp 90. The folding action creates two thicknesses of conductive outer conductor 214, as the conductor 214 is collapsed onto itself to create the collapsed outer conductor 215, which significantly improves electrical contact. FIG. 10 illustrates the folded conductor 215 in an enlarged view. The connector body engagement region 336, including sections 335 and 337, folded outer conductor 215, and clamp engagement region 382 are depicted in slightly exploded view to delineate the various components. In actuality, the components are tightly compressed together.

FIG. 10 further illustrates the arrangement of components that provide frictional forces to lock the connector 10 in place. The outer diameter of the clamp 90 and the inner diameter of the connector body 20 are sized to provide a slight radial interference fit (RIF). In concert with the radial and axial friction forces provided by compression of the first exposed outer conductor corrugation 214 between the clamp 90 and the connector body 20, the connector 10, once axially advanced into the second state, cannot be taken apart without excessive force.

FIG. 11 depicts a scenario to illustrate the folding action of the first exposed outer conductor corrugation 214. The outer conductor 214 is trimmed approximately at the first corrugation valley 216. The planar face 338 of the connector body 22 passes over the leading edge 226 of the outer conductor 214 and contacts the conductor 214 approximately near the trailing inflection point 392 of the outer conductor 214, causing the conductor 214 to fold over on itself, as depicted by the arrow. One advantage of this arrangement is that an operator preparing the cable segment 200 for insertion does not need to trim the cable 200 precisely at a corrugation valley; there is provided ample leeway on either side of the valley.

Figure 12:
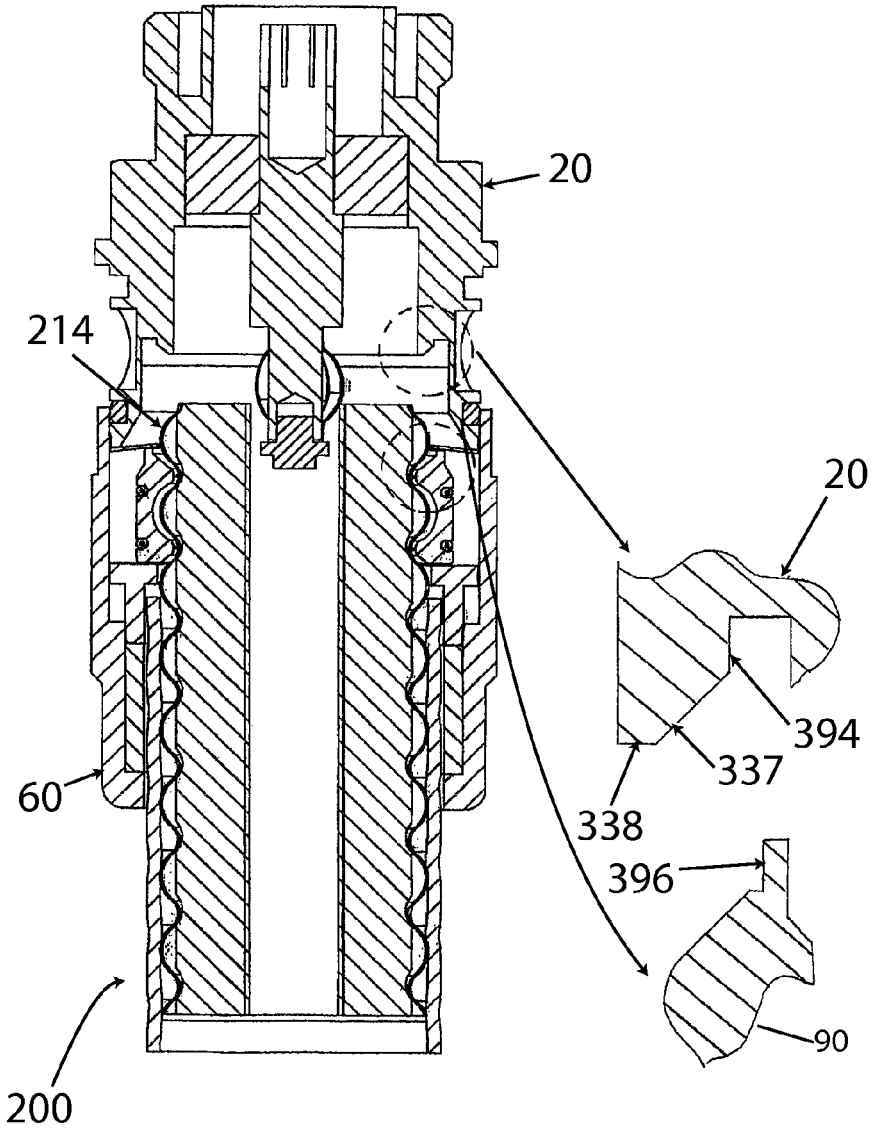
FIG. 12 is a cross sectional view of an embodiment of the connector.
Figure 13:
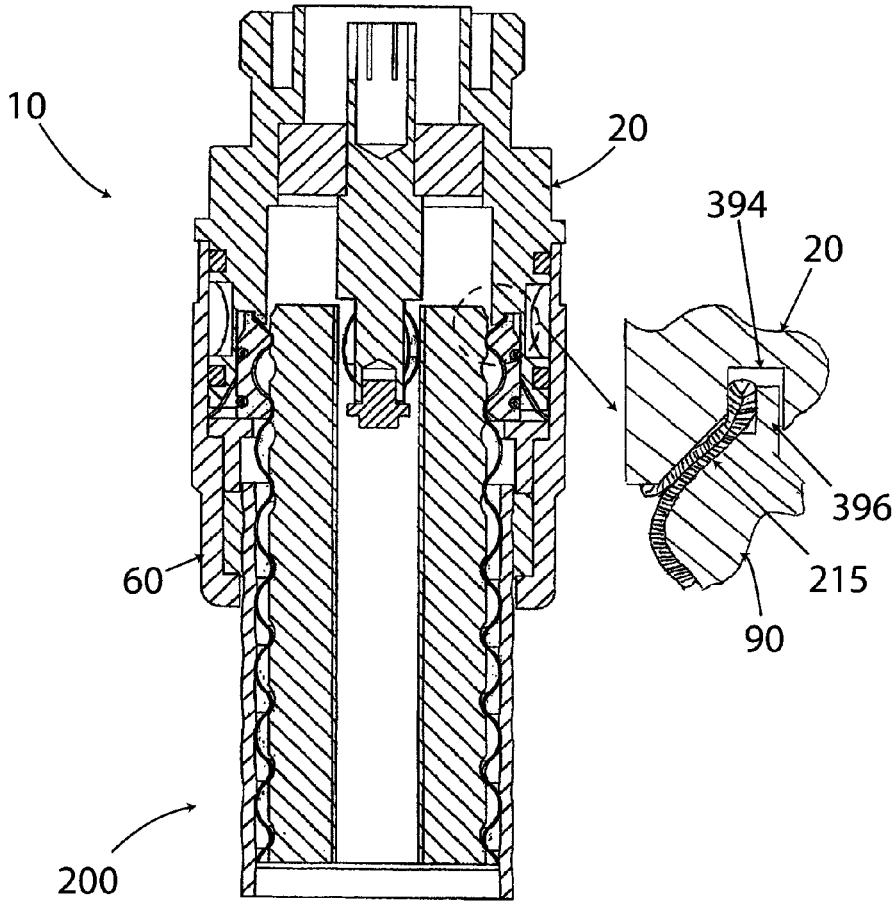
FIG. 13 is an embodiment of the connector of FIG. 12 after compression of the outer conductor of the cable.

In one embodiment, shown in FIG. 12 and enlarged in FIG. 13, the first region 335 that extends radially inward from the inner bore 26 of the connector body 20 may further comprise a retention feature 394 to further secure the deformed corrugated outer conductor 215 in a radial direction. In one example, the retention feature 394 is an annular recess in the first region 335, such that the first region 335 axially indented. Correspondingly, the clamp 90 may include a complimentary retention feature 396. In the illustrated example, the collapsed corrugated outer conductor 215 is sandwiched not only along the complimentary compression surfaces 336 and 382, but also between the retention features 394 and 396. In this manner, in the event the member 60 axially retreats from the connector body 20, the radial clamping forces acting upon the outer conductor 215 in the region of the retention features 394 and 396 are unaffected and the outer conductor 215 will not jar loose. Moreover, even though the retreat of the member 60 from the connector body 20 may result in the loss of electric coupling between the compression surfaces 336 and 382, the outer conductor 215 collapsed between retention features 394 and 396 continues to electrically couple the clamp 90 and the connector body 20, thus allowing the connector 10 to continue to provide its intended and desired function.

Figure 14:
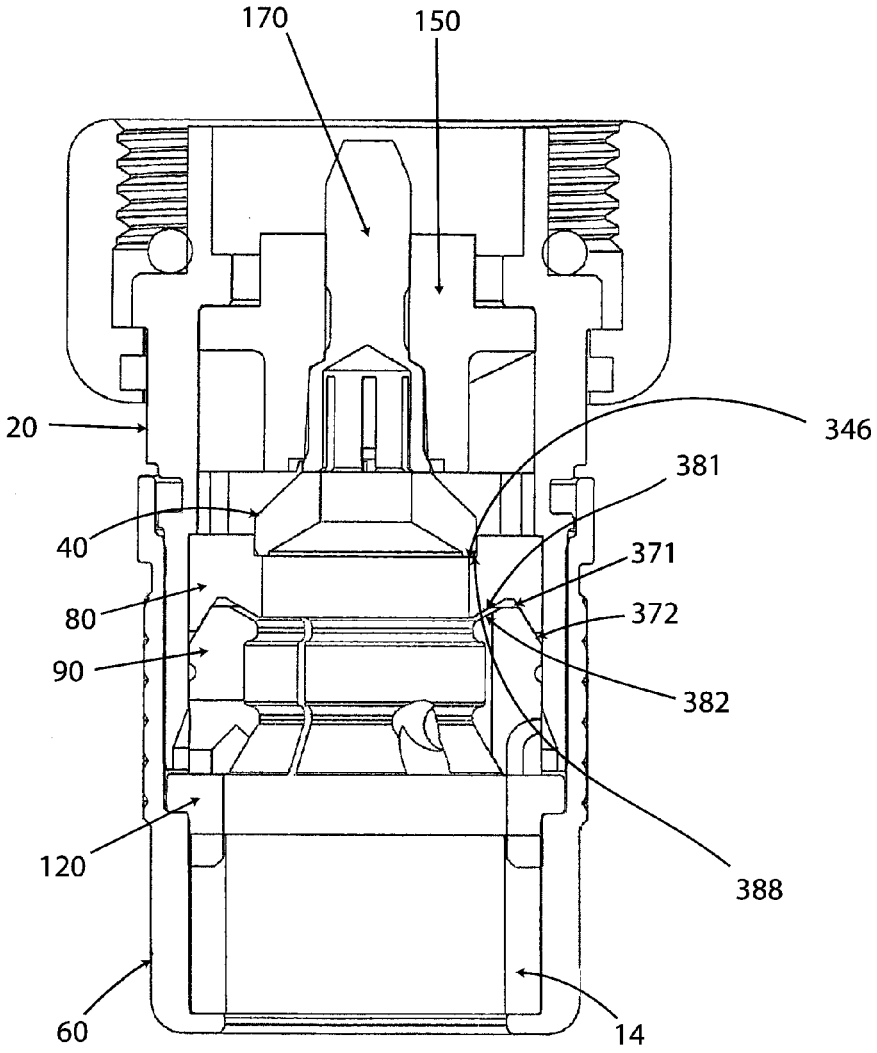
FIG. 14 is a cross sectional view of an embodiment of the connector.

In one embodiment, shown in FIG. 14, the connector is in the second state. The clamp 90 further comprises a beveled edge 372, in addition to the beveled edge 382 described above. The beveled edges 372 and 382 are positioned on opposing leading corner edges of the clamp 90, beveled edge 382 being positioned radially inward of the beveled edge 372. Beveled edge 372 is angled at an acute angle from the common axis 2, and the angle of the beveled edge 372 is less than the angle of the beveled edge 382 from the common axis 2. Beveled edges 372 and 382 function as compression surfaces under the condition that the connector is transitioned from the first state to the second state.

Corresponding compressions surfaces are found in the compression ring 80 of the embodiment of FIG. 14. Specifically, the second surface 86 of the compression ring 80 further comprises angled surfaces 381 and 371 that oppose one another and generally form a v-like shape in the second surface 86. The angled surfaces 381 and 371 correspond to and compliment the beveled edges 382 and 372, respectively. In other words, the angled surface 371 is angled from the common axis 2 at approximately the angle of the beveled edge 372. Similarly, the angled surface 381 is angled from the common axis 2 at approximately the angle of the beveled edge 382. With this configuration, as the connector 10 is transitioned from the first state to the second state, thus axially displacing the clamp 90 toward the compression ring 80, the compression surfaces, 372 and 382, on the clamp ring 90 functionally engage the corresponding compression surfaces, 371 and 381, respectively, on the compression ring 80 to compress therebetween the first exposed outer conductor corrugation 214 of the cable 200 so that the corrugation 214 collapses on itself. The result is that the collapsed corrugation 215 is pressed between the compression surfaces 372 and 371 at one angle and also pressed between the compression surfaces 382 and 381 at another angle, thus forming the v-like shaped compression. This v-shaped compression provides both axial and radial compression of the connector 10 to facilitate advantageous mechanical and electrical coupling of the connector 10 to the cable 200 in the second state and to prevent the connector 10 from disengaging without undue force once the connector 10 is moved to its second state.

Additionally, in the embodiment of FIG. 14, the compression ring 80 comprises the first surface 84 that engages the second surface 48 of the first insulator 40. The first surface 84 comprises an annular recess 388 that engages an annular angled lip 346 that axially protrudes from the second surface 48 of the first insulator 40. As the connector 10 is axially transitioned from the first state to the second state, the compression ring 80 functionally engages the first insulator 40, which in turn functionally engages the conductive pin 170 to axially advance the conductive pin 170 through the central through-bore 158 of the second insulator 150, such that the pin 170 axially protrudes beyond the first end 152 of the insulator 150 so that the pin 170 can connect to the port (not shown). Moreover, transition of the connector 10 from the first state to the second state also results in the exposed center conductor 202 being axially advanced into the socket 176 of the pin 170, such that the center conductor 202 is mechanically and electrically coupled to and secured within the pin 170. As a result, in addition to the outer conductor 206 being mechanically and electrically coupled to the connector body 20, as described above, the center conductor 202 is mechanically and electrically coupled to the pin 170, so that the connector 10 satisfactorily couples, mechanically and electrically, to the port (not shown).

Figure 15:
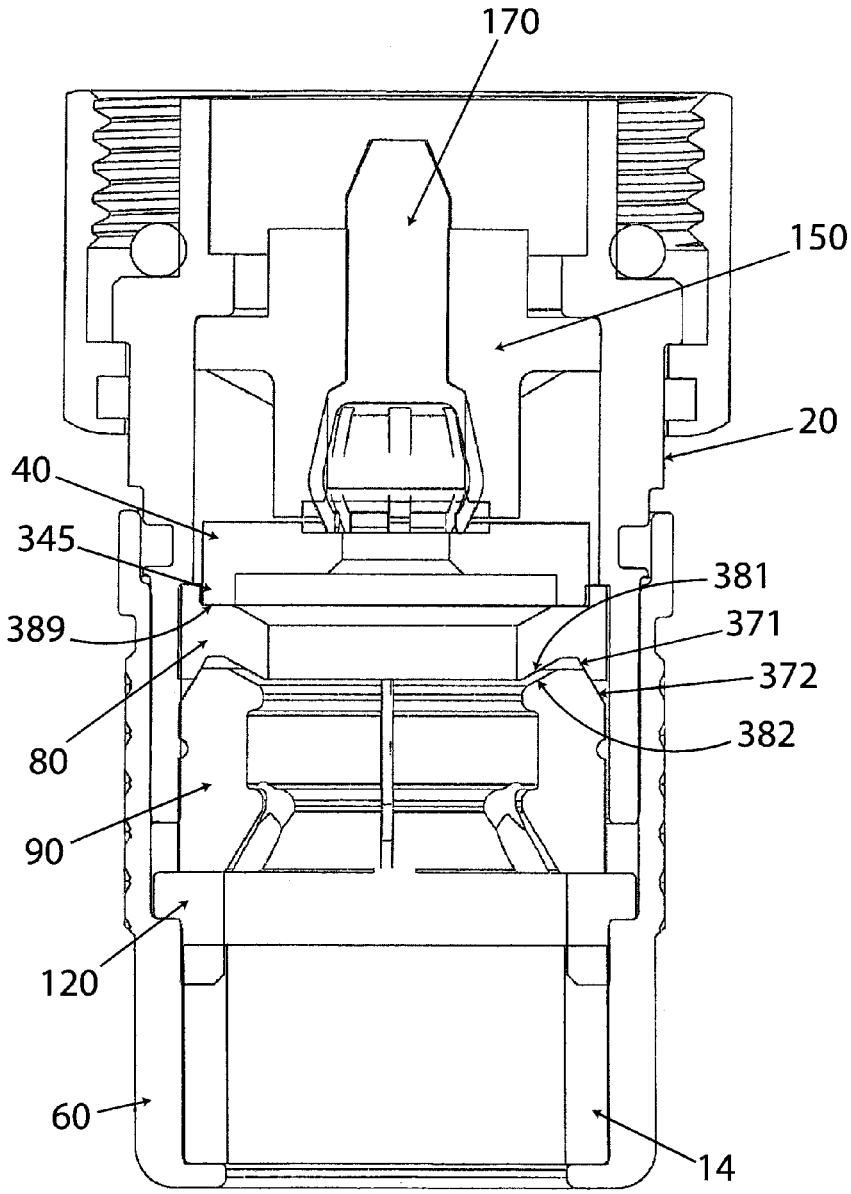
FIG. 15 is a cross sectional view of an embodiment of the connector.

In one embodiment, shown in FIG. 15, the connector 10 includes the compression surfaces 382 and 372 on the clamp 90 and the compression surfaces 371 and 381 on the compression ring 80, described above. These compression surfaces 382, 372, 381, and 371 function according to the description provided above. In addition, the embodiment of FIG. 15 further includes a planar surface 389 on the first surface 84, the planar surface 389 being structured to engage the second surface 48 of the first insulator 40. The second surface 48 of the first insulator 40 further comprises a planar annular lip 345 that engages the planar surface 389. As the connector 10 is axially transitioned from the first state to the second state, the compression ring 80 functionally engages the first insulator 40, which in turn functionally engages the conductive pin 170 to axially advance the conductive pin 170 through the central through-bore 158 of the second insulator 150, such that the pin 170 axially protrudes beyond the first end 152 of the insulator 150 so that the pin 170 can connect to the port (not shown). Moreover, transition of the connector 10 from the first state to the second state also results in the exposed center conductor 202 being axially advanced into the socket 176 of the pin 170, such that the center conductor 202 is mechanically and electrically coupled to and secured within the pin 170. As a result, in addition to the outer conductor 206 being mechanically and electrically coupled to the connector body 20, as described above, the center conductor 202 is mechanically and electrically coupled to the pin 170, so that the connector 10 satisfactorily couples, mechanically and electrically, to the port (not shown).

Figure 16:
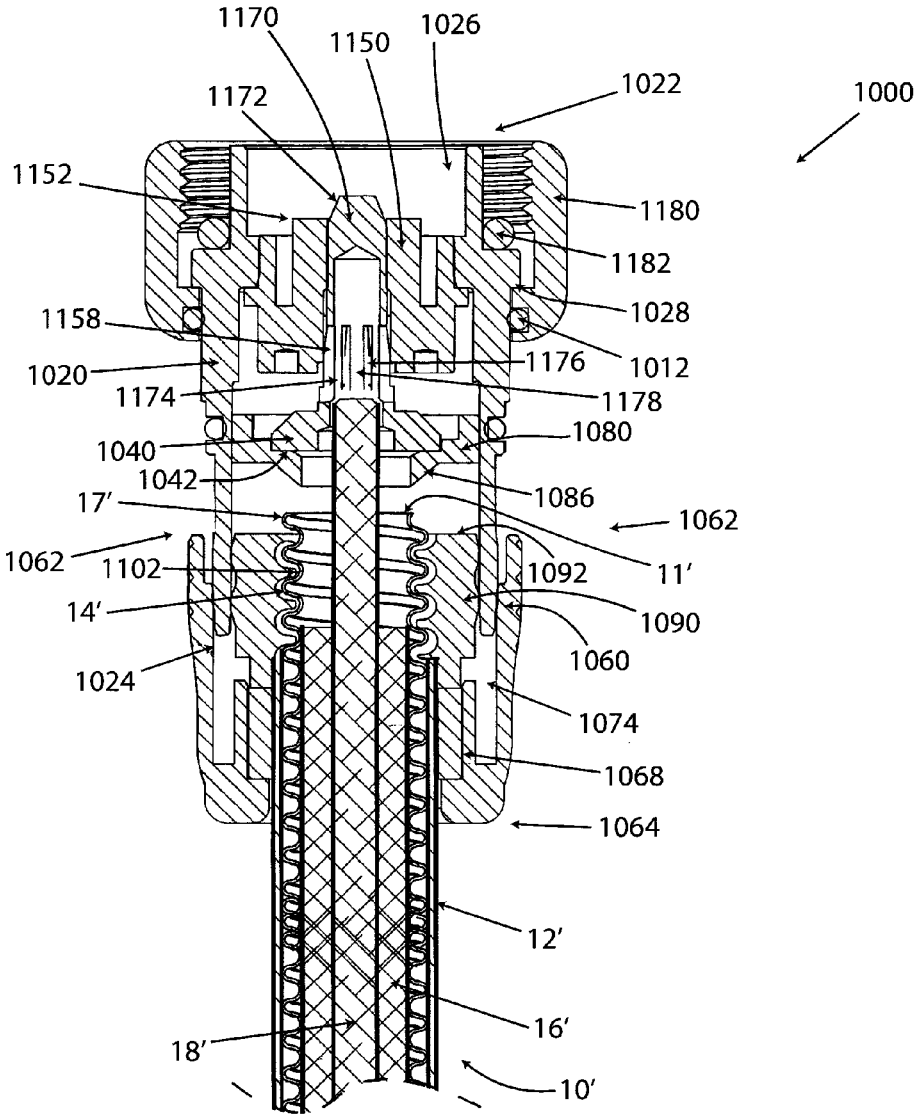
FIG. 16 depicts a cross-sectional view of an embodiment of a connector in an open position prior to insertion of a coaxial cable.

Referring now to FIG. 16, an embodiment of connector 1000 may be a straight connector, a right angle connector, an angled connector, an elbow connector, or any complimentary connector that may receive a center conductive strand 18 of a coaxial cable. Further embodiments of connector 100 may receive a center conductive strand 18 of a coaxial cable 10, wherein the coaxial cable 10' includes a corrugated, helical or spiral outer conductor 14'. For instance, one example of the cable 10' received by connector 1000 is a spiral corrugated cable, sometimes known as Superflex® cable. Examples of spiral corrugated cable include 50 ohm "Superflex" cable and 75 ohm "coral" cable manufactured by Andrew Corporation (www.andrew.com). Spiral corrugated coaxial cable is a special type of coaxial cable 10' that is used in situations where a solid conductor is necessary for shielding purposes, but it is also necessary for the cable to be highly flexible. Unlike standard coaxial cable, spiral corrugated coaxial cable has an irregular outer surface, which makes it difficult to design connectors or connection techniques in a manner that provides a high degree of mechanical stability, electrical shielding, and environmental sealing, but which does not physically damage the irregular outer surface of the cable. Ordinary corrugated, i.e., non-spiral, coaxial cable also has the advantages of superior mechanical strength, with the ability to be bent around corners without breaking or cracking. In corrugated coaxial cables, the corrugated sheath is also the outer conductor. Connector 1000 can be provided to a user in a preassembled configuration to ease handling and installation during use.

Embodiments of connector 1000 may include a connector body 1020 comprising a first end 1022, a second end 1024, and an inner bore 1026 defined between the first and second ends 1022, 1024 of the body 1020, a compression member 1060 comprising a first end 1062, a second end 1064, and an inner bore 1066 defined between the first and second ends 1062, 1064 of the member 1060, the first end 1062 of the compression member 1060 being structured to engage the second end 1024 of the connector body 1020, a clamp 1090 comprising a first end 1092, a second end 1094, an inner bore 1096 defined between the first and second ends 1092, 1094 of the clamp 1090, wherein the clamp 1090 facilitates threadable insertion of a coaxial cable 10', and a compression surface 1086 (or a surface integral to the connector body 1020 and protrudes radially inward into the inner bore 1026 of the connector body 1020) disposed within the connector body 1020, wherein axial advancement of one of the connector body 1020 and the compression member 1060 toward the other facilitates the clamp 1090 being axially advanced into proximity with the compression surface 1086 (or a surface integral to the connector body 1020 and protrudes radially inward into the inner bore 1026 of the connector body 1020) such that the clamp 1090 and the compression surface 1086 (or a surface integral to the connector body 1020 and protrudes radially inward into the inner bore 1026 of the connector body 1020) transmit force between one another. Further embodiments of connector 1000 may include a connector body 1020 having a first end 1022 and a second end 1024, a compression member 1060 configured to be axially compressed onto the connector body 1020, a clamp 1090 disposed within the connector body 1020, the clamp 1090 configured to facilitate threadable insertion of a coaxial cable 10', at least two cooperating surfaces, the cooperating surfaces configured to collapse one or more corrugations 17' of an outer conductor 14' of the coaxial cable 10' therebetween when the connector 1000 moves into a closed position. Two connectors, such as connector 100 may be utilized to create a jumper that may be packaged and sold to a consumer. A jumper may be a coaxial cable 10 having a connector, such as connector 100, operably affixed at one end of the cable 10 where the cable 10 has been prepared, and another connector, such as connector 100, operably affixed at the other prepared end of the cable 10. Operably affixed to a prepared end of a cable 10 with respect to a jumper includes both an uncompressed/open position and a compressed/closed position of the connector while affixed to the cable. For example, embodiments of a jumper may include a first connector including components/features described in association with connector 100, and a second connector that may also include the components/features as described in association with connector 100, wherein the first connector is operably affixed to a first end of a coaxial cable 10, and the second connector is operably affixed to a second end of the coaxial cable 10. Embodiments of a jumper may include other components, such as one or more signal boosters, molded repeaters, and the like.

The cable 10' may be coupled to the connector 1000, wherein the cable 10' may include a solid center conductor 18' surrounded by an insulator 16', a corrugated spiral outer conductor 14 'surrounding the insulator 16', and an insulative jacket 12' surrounding the outer conductor 14'. The prepared end of the coaxial cable 10' may include an exposed length of the center conductor 18', an exposed length 17' of the outer conductor 14' such that at least a first exposed outer conductor corrugation 17' extends a distance from the cable jacket 12'. The insulator 16' is made of a soft, flexible material, such as a polymer foam. A portion of the insulator 16' may be removed from the prepared end of the cable 10', thereby providing a "cored out" annular cavity for receiving a portion of a component of the connector 10. However, embodiments of the cable 10' may not involve coring out a portion of the dielectric 16', which both saves a step preparation of the cable 10' and allows the connector 1000 to not include a support mandrel, such as mandrel 46.

FIG. 16 depicts a cross-sectional view of an embodiment of the connector 1000 in an open position. The connector 1000 may include a tubular connector body 10120. Embodiments of the tubular connector body 1020 may share the same or substantially the same structure and function as connector body 20 described supra. For example, the connector body 1020 may include a first end 1022, a second end 1024, and an inner bore 1026. The connector body 1020 is comprised of a conductive material.

Embodiments of the connector 1000 may include a fastener 1180 operably attached to the connector body 1020 proximate the first end 1022. The fastener 1180 may be a coupling member, or a threaded nut for engagement to the port (not shown). The fastener 1180 may include a seal 1182 for sealing to the port. Alternatively, the connector 1000 may be provided with male threads for connection to a female port. The connector 1000 may also be configured as an angled connector, such as a 90 degree elbow connector.

Embodiments of connector 1000 may include a first seal 1012, such as an O-ring, that is disposed within a groove on the outer periphery of the connector body 1020 and resides between the tubular connector body 1020 and the inner bore 1066 of the compression member 1060 under the condition that the connector 1000 is in the closed position. Embodiments of the first seal 1012 may share the same or substantially the same structural and functional aspects of seal 12, as described above. Moreover, embodiments of connector 1000 may further include a second seal 1014 that is contained within the inner bore 1066 and a second flange of the compression member 1060. Embodiments of the second seal 1014 may share the same or substantially the same structural and functional aspects of seal 14, as described above.

Embodiments of a cable connector 1000 may include a first insulator 1040. The first insulator may include surface 1142 that engages the compression ring 1080, in particular, the first surface 1084. The first insulator 1040 may include a generally axial opening to accommodate the axial passage of the center conductor 18' in a closed position of connector 1000. The first insulator 1040 should be formed of insulative, non-conductive materials to facilitate the electrical isolation of the center conductor 18' and the compression ring 1080. Embodiments of the first insulator 1040 engages the compression ring 1080, but may not engage the outer conductor 14; of cable 10' to provide support in embodiments where the cable 10' does not include a cored out cavity at the prepared end of the cable 10'.

Embodiments of the cable connector 1000 may further comprise of a second insulator 1150 disposed within the inner bore 1026 of the tubular connector body 1020, proximate the first end 1022 of the connector body 1020. Embodiments of the second insulator 1050 may share the same or substantially the same structure and function as the second insulator 150, described in association with connector 10. For example, the second insulator 1150 may be comprised of a first end 1152, a second end 1156, a central through-bore 1158, and a flange 1154 that is structurally configured to slidably engage the inner bore 1026 of the tubular connector body 1020 and configured to engage a shoulder 1028 on the inner bore 1026 of the tubular connector body 1020. The second insulator 1150 may electrically isolate the center conductor 18' from the connector body 1020. The connector 1000 may further include a conductive central pin 1170 disposed within the central through-bore 1158 of the insulator 1150. The conductive central pin 1170 may be comprised of a first end 1172, a second end 1174, and an axial socket 1176 extending axially from the second end 1174. When the coaxial cable 10' is inserted into the connector 1000, the axial socket 1176 of the central pin 1170 receives an exposed tip of the center conductor 18' of the cable 10'. A plurality of slits 1178 running axially along the length of the socket 1176 may be cut into the central pin 1170 at predetermined intervals in the socket 1176, thereby defining a plurality of fingers between the slits 1178 which are structurally configured to expand when the exposed tip of the center conductor 18' prepared cable 10' is inserted into the axial socket 1176.

Embodiments of connector 1000 may further include a compression member 1060. Embodiments of the compression member 1060 may share the same or substantially the same structure and function as compression member 60 described supra. For example, compression member 1060 may include a first end 1062, a second end 1064, and an inner bore 1066 having a central shoulder 1068. The compression member 1060 may be configured to couple to the tubular connector body 1020, and more specifically to slidably engage the second end 1024 of the body 1020.

Embodiments of connector 1000 may further include a means for collapsing the first exposed corrugation 17' of the outer conductor 14' of the coaxial cable 10' in the axial direction when the compression member 1060 engages the connector body 1020 and is axially advanced further toward the connector body 1020. The particular components of the connector 10' and the means for collapsing the outer conductor 14' are described herein.

Figure 17:
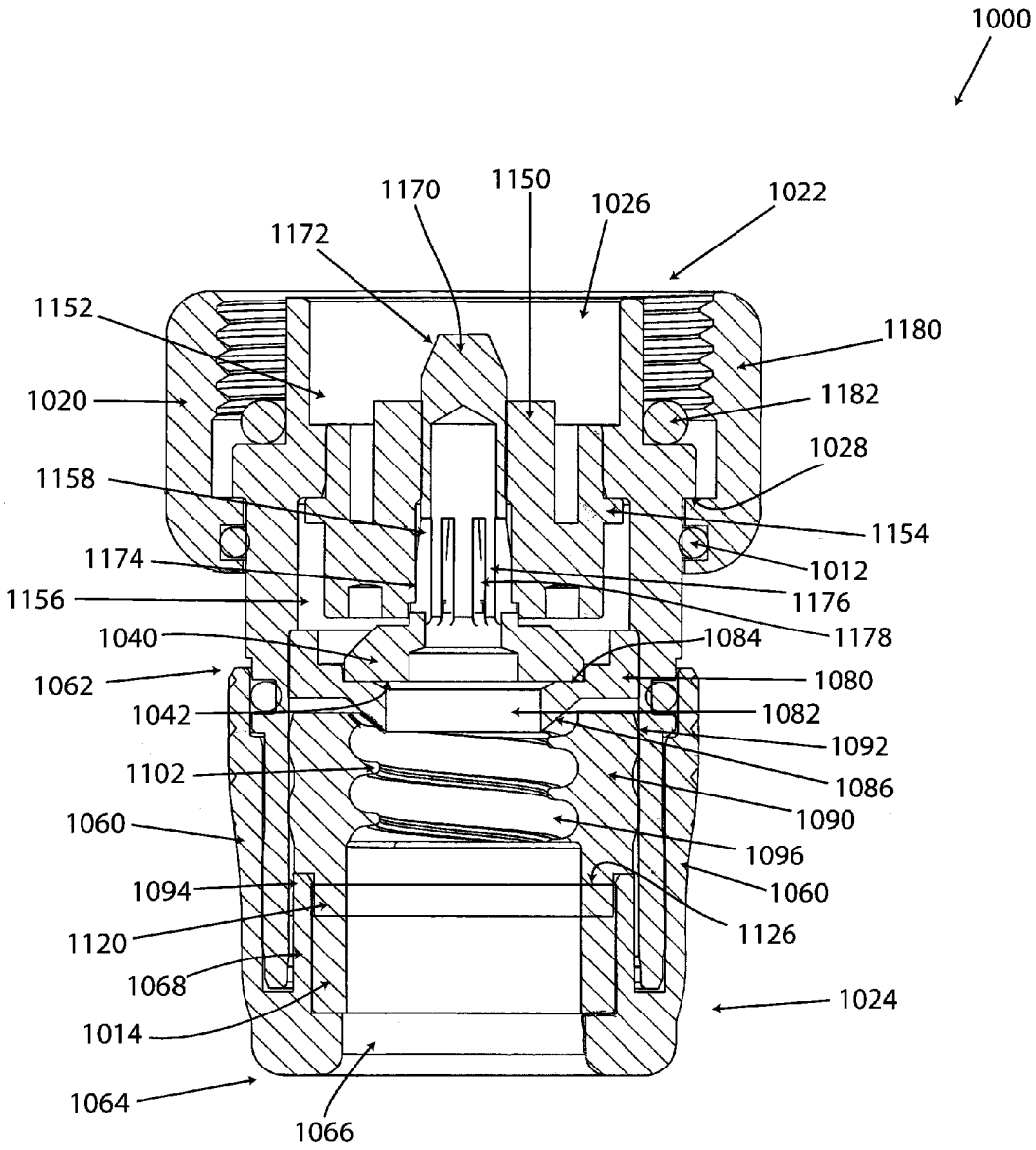
FIG. 17 depicts a cross-sectional view of an embodiment of a connector in a closed position without a coaxial cable.
Figure 18:
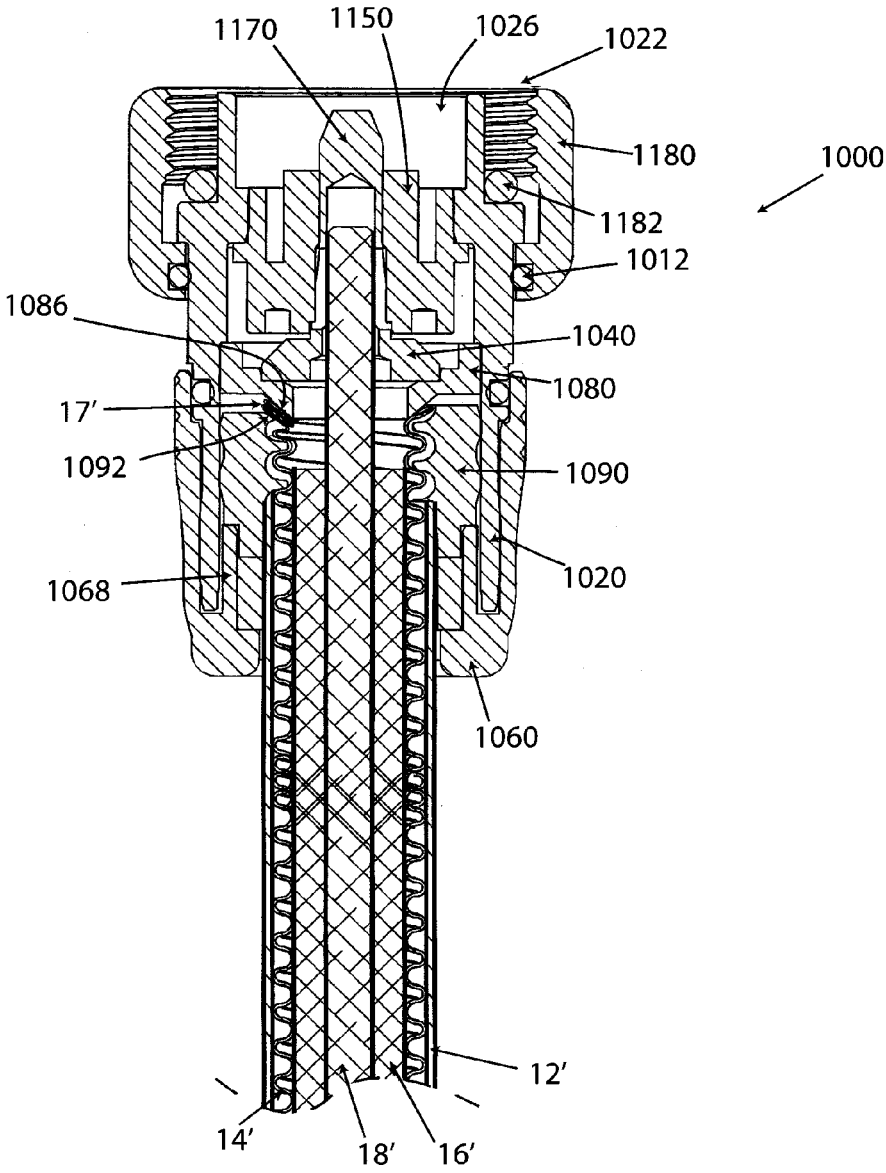
FIG. 18 depicts a cross-sectional view of an embodiment of a connector in a closed position with a coaxial cable fully threadably advanced within the connector.

Referring still to FIG. 16, and additional reference to FIGS. 17 and 18, embodiments of connector 1000 may include a conductive compression ring 1080. Embodiments of the conductive compression ring 1080 may share the same or substantially the same structure and function as conductive compression ring 80 described supra. For example, the conductive compression ring 1080 may include a first surface 1084 that engages the second surface 1048 of the first insulator 1040, and a second surface 1086 that functions as a compression surface that assists in the collapsing of the first exposed corrugation 17' of the outer conductor 14' of the coaxial cable 10'. The compression ring 1080 comprises a through hole 1082 to allow axial passage of the center conductor 18' of cable 10'.

Furthermore, embodiments of connector 1000 may include a clamp 1090 that is structured to slide within the connector 1000 and functionally engage the inner bore 1026 of the connector body 1020. Embodiments of the clamp 1090 may share similar or substantially similar structure and function as clamp 90 described above. However, clamp 1090 may not include independently radially displaceable sections. In other words, embodiments of claim 1090 may be rigid, and not include slots or other structural aspects to facilitate expansion of the clamp 1090. The clamp 1090 does not need to expand to allow insertion of the coaxial cable 10'. The clamp 1090 comprises a first end 1092, a second end 1094, a central passageway 1096, and a central annular recess 1100 defined between a first protruded edge 1098 that extends radially inward proximate the first end 1092 and a second protruded edge 1102 that extends radially inward proximate the second end 1094. The first end 1092 of the clamp 1090 functions as another compression surface that assists in the collapsing of the first exposed corrugation '17 of the outer conductor '14 of the coaxial cable 10', under the condition that the compression surface, mentioned above, is brought into proximity with the first end 1092 of the clamp 1090, the compression member 1060 is axially compressed/displaced onto the connector body 1020 to move to a closed position, as shown in FIG. 17. Moreover, the clamp 1090 may be disposed around the outer conductive strand layer 14', wherein the inner surface may threadably engage the outer conductive strand 14' and the cable jacket 12' in a closed position. The inner surface of the clamp 1090 may include a grooved portion, wherein the grooved portion corresponds to an outer surface of the outer conductive strand layer 14'. Embodiments of the clamp 1090 may include a grooved portion with threads or grooves that correspond with a helical or spiral corrugated outer conductor, such as Superflex® cable. Because the clamp 1090 is rigid and has an inner surface having grooves in a spiral or helical pattern to accommodate a spiral or helical pattern of the outer conductor 14', an installer may thread the cable 10' into mechanical engagement with the clamp 1090, which ensures proper installation (e.g. fully inserted cable 10'). In other words, the clamp 1090 is configured to facilitate threadable insertion of the coaxial cable 10'.

Embodiments of connector 1000 may further comprise a clamp push ring 1120. Embodiments of the clamp push ring 1120 may share the same or substantially the same structural and functional aspects of the clamp push ring 120 describes supra. For example, the clamp push ring 1120 is structurally configured to slidably engage the central shoulder of 1068 of the compression member 1060. The clamp push ring 1120 may further comprise a first end 1126 that is structured to functionally engage the second end 1094 of the clamp 1090. In other embodiments, the compression member 1060 is structured to functionally engage the clamp 1090 directly, such that axial advancement of the compression member 1060 results in the axial advancement of the clamp 1090.

The prepared cable end is disposable in the connector 1000, and is shown disposed within the connector 1000 in FIG. 16, wherein the connector 1000 and the cable 10' are in an open position. To reach the open position shown in FIG. 16, the prepared cable end is inserted into the inner bore 1066 of the compression member 1060 until the leading edge 11' of the corrugated outer conductor 14' engages the clamp 1090. Upon engagement, the cable 10' is further threadably axially advanced through the central passageway 1096 so that the spiral/helical shaped grooves on the inner surface of the clamp 1090 mate with the spiral/helical shaped outer conductor 14' of the cable 10 to threadably axially move further within the connector body 1020. As the cable 10' is fully threaded, or close to fully threaded into engagement with the clamp 1090, the first exposed corrugation '17 of the cable 10' can engage the conductive compression ring 1080, as the connector 1000 is moved to a closed position.

FIG. 18 depicts an embodiment of a closed position of connector 100 with the outer conductor 14' collapsed between the compression surfaces 1086, 1092. As the first exposed corrugation 17' engages the conductive compression ring 1080, it may deform against an angled surface (i.e. surface 1086) of the conductive compression ring 1080, as described above. The cooperating compression surfaces 1086, 1092 of the conductive compression ring 1080 and the clamp 1090 serve to collapse, crush, deform, and/or fold the corrugated outer conductor 14' over itself to pinch, lock, seize, clamp, etc. the outer conductor 14' of the cable 10'. Those skilled in the art should understand that the manner in which the outer conductor 14' is pinched/collapsed/folded between the two cooperating compression surfaces is similar or the same as described in association with connector 10 above, with the exception that the outer conductor 14' has a spiral corrugation, and the clamp 1090 is rigid (e.g. doesn't have to displace to allow entry of the cable 10', and facilitates threadable insertion of the cable 10').

Figure 19:
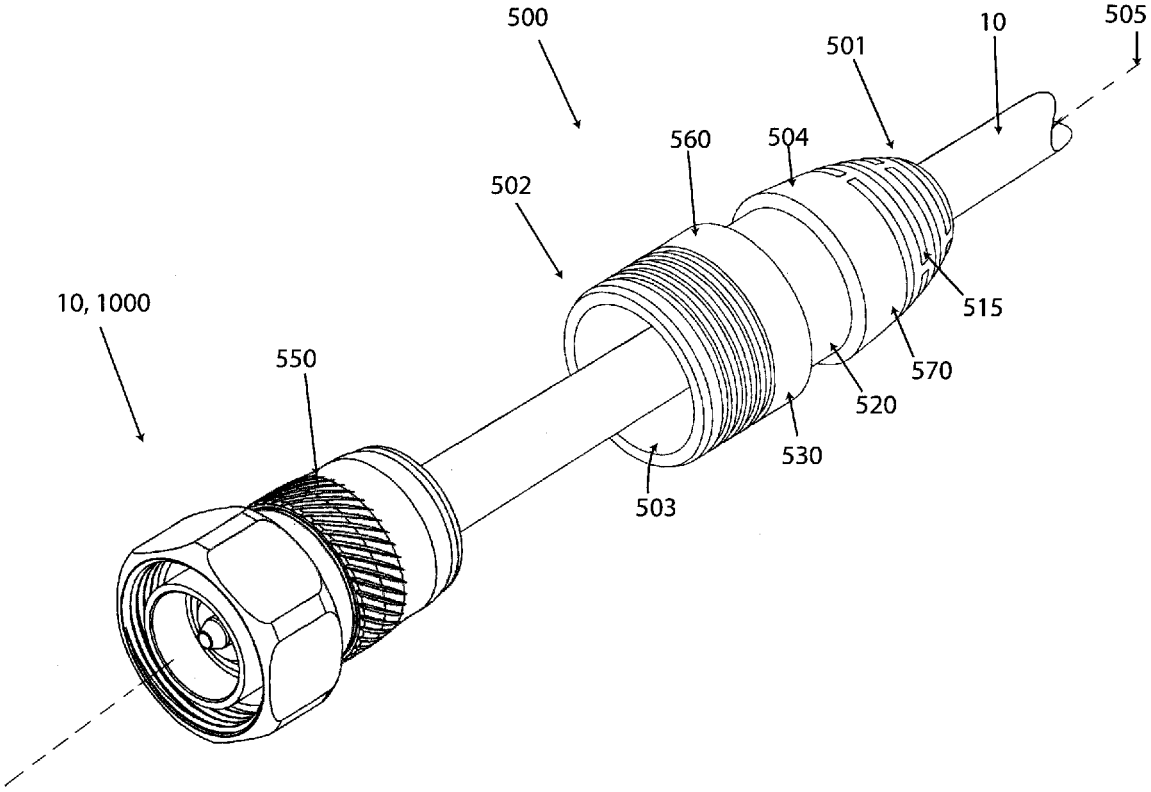
FIG. 19 depicts a perspective view of an embodiment of a coaxial cable connector having a cover in a first position.
Figure 20:
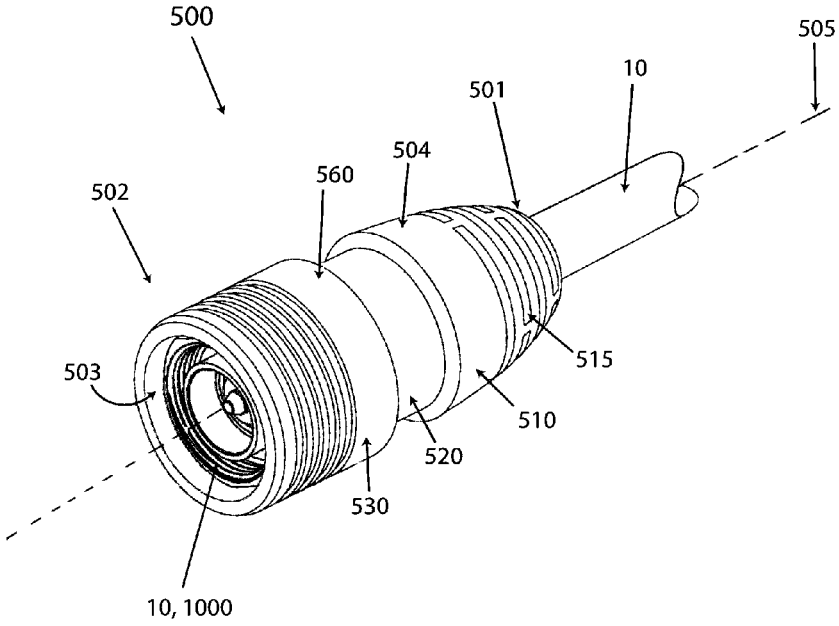
FIG. 20 depicts a perspective view of an embodiment of the coaxial cable connector having a cover in a second, sealing position.

With continued reference to the drawings, FIGS. 19 and 20 depict an embodiment of connector 10, 1000 having a cover 500. FIG. 19 depicts an embodiment of connector 10, 1000 having a cover 500 in a first position. FIG. 20 depicts an embodiment of connector 10, 1000 having a cover 500 in a second, sealing position. Cover 500 may be a seal, a sealing member, a sealing boot, a sealing boot assembly, and the like, that may be quickly installed and/or removed over a connector, such as connector 10, 1000, and may terminate at a bulkhead of a port or at a sliced connection with another coaxial cable connector of various sizes/shapes. Cover 500 can protect the cable connectors or other components from the environment, such as moisture and other environmental elements, and can maintain its sealing properties regardless of temperature fluctuations. Embodiments of cover 500 may be a cover for a connector 10, 1000 adapted to terminate a cable 10, wherein the cover 500 comprises an elongated body 560 comprising a cable end 501 and a coupler end 502, an interior surface 503 and an exterior surface 504, wherein the elongated body 560 extends along a longitudinal axis 505. The interior surface 503 can include a first region 510 adapted to cover at least a portion of the cable 10 and can extend from the cable end 501 to a first shoulder, wherein the first region is of a minimum, first cross-sectional diameter. The interior surface 503 may further include a second region 520 which is adapted to cover at least the connector body portion 550 and which may extend from the first shoulder to a second shoulder. The second region 520 may have a minimum, second cross-sectional diameter that is greater than the minimum, first cross-sectional diameter. The interior surface 503 may further include a third region 530 which is adapted to cover at least a portion of the connector 200 and which extends from the second shoulder to the coupler end 502. The third region 530 may have a minimum, third cross-sectional diameter that is greater than the minimum, second cross-sectional diameter. Further embodiments of the cover 500 may include a plurality of circumferential grooves 515 to provide strain relief as the cover moves from the first position to the second position. The circumferential grooves 515 can extend less than completely around the circumference of the first region 510 of cover 500. Furthermore, embodiments of the cover 500 may comprise an elastomeric material that maintains its sealing abilities during temperature fluctuations. In one embodiment, the cover 500 is made of silicone rubber.

Referring now to FIGS. 1-20, a method of connecting a compression connector to a coaxial cable may include the steps of providing a connector body 1020 having a first end 1022 and a second end 1024, a compression member 1060 configured to be axially compressed onto the connector body 1020, a clamp 1090 disposed within the connector body 1020, the clamp 1090 configured to facilitate threadable insertion of a coaxial cable 10', at least two cooperating surfaces, the cooperating surfaces configured to collapse one or more corrugations 17' of an outer conductor 14' of the coaxial cable 10' therebetween when the connector 1000 moves into a closed position, threadably advancing a coaxial cable 10' into the connector body 1020, wherein a spiral corrugated outer conductor 14' of the coaxial cable 10' threadably mates with a spiral grooved portion of an inner surface of the clamp 1090, and axially compressing the compression member 1060 onto the connector body 1020 to move the connector 1000 to a closed position.

While the present invention has been described with reference to a number of specific embodiments, it will be understood that the true spirit and scope of the invention should be determined only with respect to claims that can be supported by the present specification. Further, while in numerous cases herein wherein systems and apparatuses and methods are described as having a certain number of elements it will be understood that such systems, apparatuses and methods can be practiced with fewer than the mentioned certain number of elements. Also, while a number of particular embodiments have been described, it will be understood that features and aspects that have been described with reference to each particular embodiment can be used with each remaining particularly described embodiment.

What is claimed is:

1. A compression connector, the compression connector configured to receive a coaxial cable having an inner conductor, an exposed outer corrugated conductor, an insulator disposed between the inner and outer conductors, and a protective jacket disposed over the corrugated outer conductor, the compression connector comprising:

a connector body comprising a first end, a second end, an outer diameter, and an inner bore having a diameter, the inner bore defined between the first end and the second end of the connector body;

a compression member comprising a first end, a second end, and an inner bore defined therebetween, the inner bore of the compression member having a diameter slightly smaller than the outer diameter of the connector body, the first end of the compression member being structured to slidably axially engage the second end of the connector body;

a clamp having an outer diameter slightly larger than the diameter of the inner bore of the connector body, wherein the clamp is configured to slide axially within a portion of the connector body and securely engage the inner bore of the connector body, the clamp comprising a first end, a second end, an inner bore defined between the first end and the second end of the clamp, wherein the clamp is configured to facilitate threadable engagement of the exposed outer corrugated conductor of the coaxial cable, and, wherein the first end of the clamp comprises an outer beveled edge and an inner beveled edge, the beveled edges being configured to form a v-shape; and a conductive compression ring axially slidably movable within the connector body, the conductive compression ring having a first end, a second end, an angled compression surface, and a second angled surface intersecting with the angled compression surface so as to form a v-shaped indentation in the second end of the conductive compression ring, wherein the v-shape in the first end of the clamp is configured to fit within the v-shaped indentation of the second end of the conductive compression ring; and further wherein slidable axial advancement of one of the connector body and the compression member toward the other from a first position, wherein the coaxial cable is received within the connector, to a second position, wherein the clamp is slidably axially compressed into secure engagement with the inner bore of the connector body and axially advanced into proximity with the angled compression surface such that a portion of an outer conductor of the coaxial cable is compressed between a portion of the v-shape in the first end of the clamp and the angled compression surface of the v-shaped indentation in the second end of the conductive compression ring, to facilitate electrical coupling of the outer conductor of the cable and effectuate advantageous radial clamping forces acting upon the portion of outer conductor of the cable, when the connector is moved to the second position, thereby preventing the outer conductor of the cable from disengaging without undue force and retaining mechanical coupling of the exposed outer corrugated conductor with the clamp and the angled compression surface regardless of whether the compression member remains securely engaged to the connector.

2. The connector of claim 1, wherein the clamp includes inner grooves that correspond to an outer surface of the exposed outer corrugated conductor of the coaxial cable, further wherein the outer surface has a spiral corrugation.

3. The connector of claim 1, wherein the clamp is rigid.

4. The compression connector of claim 1, further comprising:

a clamp ring comprising a first end, a second end, an inner bore defined between the first and second ends of the clamp ring, the clamp ring being structured to functionally engage the inner bore of the compression member;

a first insulator having a first end, a second end, and an inner bore defined between the first and second ends of the first insulator, the first insulator electrically isolating a socket and the conductive compression ring;

a conductive pin having a first end, a second end, and a flange extending radially outward from the pin in a central region of the pin, wherein the pin is disposed within and slidably engages the inner bore of the insulator, the flange being structured to engage the second end of the insulator; and a second insulator having a first end, a second end, and an inner bore defined between the first and second ends of the second insulator, the second insulator electrically isolating the conductive pin and the connector body.

5. The compression connector of claim 4, wherein, under the condition that one of the compression member and the connector body are axially advanced toward the other, the compression member functionally engages the clamp ring to axially advance the clamp ring, the clamp ring functionally engages the clamp to slidably axially advance the clamp toward the angled compression surface, the slidable axial advancement of the compression member and the connector body toward one another results in the transmission of force between the clamp and the angled compression surface.

6. The compression connector of claim 1, wherein the connector further comprises:

a shoulder on the inner bore of the connector body; and a shoulder on the inner bore of the compression member.

7. The compression connector of claim 1, wherein the angled compression surface is separated from the compression member.

8. A coaxial cable connector, the coaxial cable connector configured to receive a coaxial cable having an inner conductor, an exposed outer corrugated conductor, an insulator disposed between the inner and outer conductors, and a protective jacket disposed over the corrugated outer conductor, the coaxial cable connector comprising:

a connector body having a first end, a second end, and an inner bore defined therebetween, the connector body having an outer diameter;

a compression member having a first end, a second end, an outer diameter, and an inner bore defined therebetween, the inner bore having a diameter slightly smaller than the outer diameter of the connector body, the compression member structured to axially engage the second end of the connector body;

a clamp having an outer diameter slightly larger than the diameter of the inner bore of the connector body, the clamp disposed within the connector body and having a first end, a second end, and an inner bored defined therebetween, wherein the clamp threadable engages the exposed outer corrugated conductor;

at least two cooperating surfaces, one of the at least two surfaces being an oblique compression surface of a compression ring axially slidably movable within the connector body, the oblique compression surface of the compression ring forming a portion of a v-shaped indentation in the compression ring, and the other cooperating surface being located on the clamp, so that the cooperating surface of the clamp movably fits within a portion of the v-shaped indentation of the compression ring;

wherein the at least two cooperating surfaces are configured to collapse one or more corrugations of the exposed outer corrugated conductor of the coaxial cable to facilitate electrical coupling of the exposed outer corrugated conductor and effectuate advantageous radial clamping forces acting upon the collapsed portion of the exposed outer corrugated conductor of the coaxial cable when the coaxial cable connector is moved from a first position, where the coaxial cable is received within the coaxial cable connector, to a second position, where the clamp is slidably axially compressed into secure engagement with the inner bore of the connector body and the cooperating surface of the clamp is moved within a portion of the v-shaped indentation of the compression ring so that the exposed outer corrugated conductor of the coaxial cable is compressed between the cooperating surfaces, thereby retaining the mechanical coupling of the exposed outer corrugated conductor of the coaxial cable with the coaxial cable connector regardless of whether the compression member remains securely engaged to the connector body.

9. The coaxial cable connector of claim 8, wherein the clamp includes inner grooves that correspond to an outer surface of the exposed outer corrugated conductor of the coaxial cable, further wherein the outer surface has a spiral corrugation.

10. The connector of claim 8, wherein the clamp is rigid.

11. The connector of claim 8, wherein the at least two cooperating surfaces are separated from the compression member.

12. A method of connecting a compression connector to a coaxial cable, the method comprising:

obtaining a compression member having a first end, a second end, and an inner bore having a diameter;

inserting a clamp having an inner bore into the inner bore of the compression member, the clamp having an outer diameter;

inserting a clamp ring having an inner bore into the inner bore of the compression member;

advancing a prepared end of a coaxial cable into the second end of the compression member and through the inner bore of the clamp until a first corrugated section of an outer conductor of the coaxial cable protrudes beyond the first end of the clamp and the inner bore of the clamp engages a second corrugated section of the outer conductor;

obtaining a connector body having a first end, a second end, an outer diameter slightly larger than the diameter of the inner bore of the compression member, and an inner bore having a diameter slightly smaller than the outer diameter of the clamp;

inserting an insulator having a through-hole into the inner bore of the connector body;

inserting a pin in the through-hole of the insulator;

inserting a compression ring having a first end, a second end, and an inner bore within the inner bore of the connector body;

inserting a second insulator having a first end, a second end, an inner bore within the inner bore of the connector body, and a tubular mandrel extending axially from the second end of the second insulator, wherein the tubular mandrel functionally engages the inner bore of the compression ring and the second end of the second insulator functionally engages the first end of the compression ring;

coupling the compression member to the connector body by functionally engaging the first end of the compression member with the second end of the connector body to arrange the connector in a first position, wherein the coaxial cable is received within the coaxial cable connector;

slidably axially advancing the compression member and the connector body toward one another such that the clamp slidably axially advances to a second position, wherein the clamp is securely engaged with the inner bore of the connector body and moved into proximity of an oblique compression surface disposed within the connector body so that a corrugated section of the outer conductor collapses between the clamp and the oblique compression surface to facilitate electrical coupling of the outer conductor and effectuate advantageous radial clamping forces acting upon the collapsed portion of outer conductor of the cable, when the connector is moved to the second position, thereby preventing the outer conductor of the cable from disengaging without undue force and retaining the mechanical coupling of the outer conductor of the outer conductor with the clamp and the oblique compression surface regardless of whether the compression member remains securely engaged to the connector body; and coupling a portion of the inner conductor of the coaxial cable with the pin, wherein under the condition that one of the compression member and the connector body is slidably axially advanced toward the other, the connector body functionally engages and axially advances the insulator, which functionally engages and slidably axially advances the pin, which functionally engages and slidably axially advances the second insulator, which functionally engages and slidably axially advances the compression ring, such that the pin functionally engages the center conductor of the coaxial cable and the clamp, and the second end of the compression ring, in cooperation with the clamp, collapse therebetween the corrugated section of the outer conductor.

13. The method of claim 12, wherein the oblique compression surface is a first surface of the conductive compression ring.

14. The method of claim 12, wherein the clamp includes inner grooves that correspond to an outer surface of the outer conductor of the coaxial cable, further wherein the outer surface has a spiral corrugation.

15. The method of claim 12, wherein the clamp is non-slotted.

* * * * *